US009962694B2

(12) United States Patent
Kirschhoffer et al.

(10) Patent No.: US 9,962,694 B2
(45) Date of Patent: May 8, 2018

(54) MULTIWELL PLATE

(71) Applicant: 3M INNOVATIVE PROPERTIES COMPANY, St. Paul, MN (US)

(72) Inventors: Jon A. Kirschhoffer, Stillwater, MN (US); Andrew H. Tilstra, Shoreview, MN (US); Wensheng Xia, Woodbury, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days. days.

(21) Appl. No.: 15/613,004

(22) Filed: Jun. 2, 2017

(65) Prior Publication Data

US 2017/0266663 A1 Sep. 21, 2017

Related U.S. Application Data

(63) Continuation of application No. 14/404,979, filed as application No. PCT/US2013/042563 on May 24, 2013, now Pat. No. 9,700,887.

(60) Provisional application No. 61/655,619, filed on Jun. 5, 2012.

(51) Int. Cl.
*B01L 3/00* (2006.01)

(52) U.S. Cl.
CPC ..... *B01L 3/50255* (2013.01); *B01L 2200/025* (2013.01); *B01L 2200/028* (2013.01); *B01L 2200/0631* (2013.01); *B01L 2300/0681* (2013.01); *B01L 2300/0829* (2013.01); *B01L 2300/0851* (2013.01)

(58) Field of Classification Search
CPC ..... B01L 3/5025; B01L 3/50255; B01L 2300/0681
USPC ..... 422/534, 551, 552, 553
See application file for complete search history.

(56) References Cited

U.S. PATENT DOCUMENTS

| | | | |
|---|---|---|---|
| 2002/0001854 | A1 | 1/2002 | Lee |
| 2002/0125197 | A1 | 9/2002 | Hager et al. |
| 2003/0080454 | A1 | 5/2003 | Moll et al. |
| 2003/0091989 | A1 | 5/2003 | Davis et al. |
| 2004/0158188 | A1 | 8/2004 | Kauffmann et al. |

(Continued)

FOREIGN PATENT DOCUMENTS

| | | |
|---|---|---|
| DE | 10 2007 014 729 | 9/2008 |
| EP | 1 588 764 | 10/2005 |

(Continued)

OTHER PUBLICATIONS

Berry, E.D. et al.; "Hydroxyapatite Adherence as a Means to Concentrate Bacteria"; Applied and Environmental Microbiology; vol. 63, No. 10; 1997; pp. 4069-4074.

(Continued)

*Primary Examiner* — Jill Warden
*Assistant Examiner* — Dwayne K Handy

(57) ABSTRACT

An assembly for processing a sample is provided. The assembly comprises a first body having a plurality of spaced-apart conduits and a second body having a plurality of chambers wherein each conduit is fluidically connected to a separate chamber. The assembly forms a plurality of liquid flow paths, each flow path comprising a conduit and a chamber. An analyte capture element is detachably attached to a conduit and is in fluidic communication with the liquid flow path of the conduit. Optionally, the assembly further may comprise a third body comprising a plurality of reservoirs. The assembly can be used to process a liquid sample for detecting an analyte.

18 Claims, 9 Drawing Sheets

(56) References Cited

U.S. PATENT DOCUMENTS

| | | | | |
|---|---|---|---|---|
| 2005/0103703 | A1 | 5/2005 | Young et al. | |
| 2005/0236317 | A1 | 10/2005 | Desilets ..... | B01L 3/50255 210/323.1 |
| 2007/0298451 | A1 | 12/2007 | Ribault et al. | |
| 2008/0299621 | A1 | 12/2008 | Tatnell et al. | |
| 2010/0209961 | A1 | 8/2010 | Kshirsagar et al. | |

FOREIGN PATENT DOCUMENTS

| | | |
|---|---|---|
| EP | 1 813 949 | 8/2007 |
| EP | 1 953 552 | 8/2008 |
| WO | WO 1993/11221 | 6/1993 |
| WO | WO 1996/41810 | 12/1996 |
| WO | WO 1997/08306 | 3/1997 |
| WO | WO 2008/006617 | 1/2008 |
| WO | WO 2008/134472 | 11/2008 |
| WO | WO 2009/046191 | 4/2009 |
| WO | WO 2010/075116 | 7/2010 |
| WO | WO 2010/078234 | 7/2010 |
| WO | WO 2012/066032 | 5/2012 |
| WO | WO 2012/092123 | 7/2012 |
| WO | WO 2012/122088 | 9/2012 |
| WO | WO 2013/184397 | 12/2013 |

OTHER PUBLICATIONS

Oster, J. et al.; "Polyvinyl-alcohol-based magnetic beads for rapid and efficient separation of specific or unspecific nucleic acid sequences"; Journal of Magnetism and Magnetic Materials; vol. 225; 2001; pp. 145-150.

MULTIWELL PLATE

CROSS REFERENCE TO RELATED APPLICATIONS

This application is a continuation of U.S. application Ser. No. 14/404,979, filed Dec. 2, 2014, which is a national stage filing under 35 U.S.C. 371 of International Application No. PCT/US2013/042563, filed May 24, 2013, which claims priority to U.S. Provisional Application No. 61/655,619, filed Jun. 5, 2012, the disclosures of which are incorporated by reference in their entirety herein.

BACKGROUND

Many types of samples (e.g., clinical, environmental, food, and beverage samples) are routinely tested for the presence or absence of microorganisms. In particular many samples are tested for the presence of pathogenic microorganisms. Often, the samples require various types of pre-treatment (i.e., processing prior to a detection step) in order to increase the number of target microorganisms, decrease, the number of non-target microorganisms, concentrate the microorganisms, and/or reduce the quantity of potentially-interfering material in the sample. The pre-treatment steps may be laborious and can take several hours to several days to complete. A variety of materials and devices have been developed to reduce the number of steps and the time that it takes to complete the pre-treatment of samples.

Processing a plurality of samples simultaneously can be difficult because of the lack of simple, efficient devices for the procedure. There remains a need for simple methods to prepare one or more samples for the detection of microorganisms.

SUMMARY

In general, the invention is directed to the detection of a microorganism in a sample. In particular, the present disclosure provides an assembly and a corresponding method of use for processing a sample to detect the presence or absence of an analyte associated with a microorganism. Advantageously, the assembly is configured to process, through separate flow paths, a plurality of samples and to capture an analyte from each sample on an analyte capture element. Some of the samples may be processed consecutively and/or simultaneously. Moreover, the assembly is configured to minimize cross-contamination of the liquid samples and the analyte capture elements during the use of the assembly.

In one aspect, the present disclosure provides an assembly for processing a sample. The assembly can comprise a first body comprising a plurality of spaced-apart conduits, a second body operably coupled to the first body, and a capture element. The conduits can be configured in a linear array. The plurality of conduits can comprise a first conduit having a first opening and a second opening and a second conduit adjacent the first conduit, the second conduit having a first opening and a second opening. The second body can comprise a plurality of spaced-apart chambers; each chamber having conduit-receiving opening, an interior volume, and a drain. The plurality of spaced-apart chambers can comprise a first chamber having a first interior volume and a first drain and a second chamber adjacent the first chamber, the second chamber having a second interior volume and a second drain. When the first body and the second body are operably coupled, a portion of the first conduit can be disposed in the first interior volume forming a first flow path including the first drain, and a portion of the second conduit can be disposed in the second interior volume forming a second flow path including the second drain. The capture element can be detachably attached to the first conduit and disposed in fluidic communication with the first flow path. A first shortest distance between the second opening of the first conduit and the second opening of the second conduit is shorter than a second shortest distance between the first drain and the second drain. In any embodiment, each of the plurality of chambers can comprise a floor, wherein the floor of each of the plurality of chambers comprises the drain. In any of the above embodiments, the capture element can comprise a capture element depth and the assembly has a third shortest distance between the second opening of a conduit and the floor of the receiving chamber in which the portion of the conduit is disposed, wherein in the capture element depth is longer than the third shortest distance.

In another aspect, the present disclosure provides an assembly for processing a sample. The assembly can comprise a first body comprising a plurality of spaced-apart conduits, a second body operably coupled to the first body, and a capture element. The conduits can be configured in a linear array. The plurality of conduits can comprise a first conduit having a first opening and a second opening and a second conduit adjacent the first conduit, the second conduit having a first opening and a second opening. The second body can comprise a plurality of spaced-apart chambers; each chamber having conduit-receiving opening, an interior volume, and a drain. The plurality of spaced-apart chambers can comprise a first chamber having a first interior volume and a first drain and a second chamber adjacent the first chamber, the second chamber having a second interior volume and a second drain. When the first body and the second body are operably coupled, a portion of the first conduit can be disposed in the first interior volume forming a first flow path including the first drain, and a portion of the second conduit can be disposed in the second interior volume forming a second flow path including the second drain. The capture element can comprise a capture element depth and can be detachably attached to the first conduit and disposed in fluidic communication with the first flow path. The assembly can have a third shortest distance between the second opening of a conduit and the floor of the receiving chamber in which the portion of the conduit is disposed, wherein in the capture element depth is longer than the third shortest distance. In any embodiment, a first shortest distance between the second opening of the first conduit and the second opening of the second conduit can be shorter than a second shortest distance between the first drain and the second drain.

In any of the above embodiments, at least a portion of the capture element can be disposed in the first conduit. In any of the above embodiments, the assembly further can comprise a third body operably coupled to the first body of the assembly, wherein the third body comprises a plurality reservoirs, each reservoir comprising an outlet and the plurality of outlets forming a linear array, wherein the plurality of outlets comprises a first outlet and a second outlet wherein, when operably coupled to the first body of the assembly, the first outlet is placed in fluidic communication with the first conduit and the second outlet is placed in fluidic communication with the second conduit.

In any embodiment wherein the assembly comprises a first body, the first body or third body can comprise a first positioning element configured to orient the third body in a predefined location with respect to the first body. In some embodiments, the first or third body further can comprise a second positioning element configured to act cooperatively with the first positioning element to orient the third body in a predefined location with respect to the first body.

In any of the above embodiments, the plurality of conduit openings can be configured in a substantially linear arrangement, wherein at least three of the plurality of drains is configured in a saw-toothed arrangement. In any of the above embodiments, the second body can be adapted to be operationally connected to a vacuum source.

In yet another aspect, the present disclosure provides a kit comprising the assembly of any one of the above embodiments of the assembly.

In yet another aspect, the present disclosure provides a kit. The kit can comprise a first body comprising a plurality of spaced-apart conduits and a second body configured to operably attach to the first body. The conduits can be configured in a linear array. The plurality of conduits can comprise a first conduit having a first opening and a second opening and a second conduit adjacent the first conduit, the second conduit having a first opening and a second opening. The second body can comprise a plurality of spaced-apart chambers; each chamber having conduit-receiving opening, an interior volume, and a drain. The plurality of spaced-apart chambers can comprise a first chamber having a first interior volume and a first drain and a second chamber adjacent the first chamber, the second chamber having a second interior volume and a second drain. When the first body and the second body are operably coupled, a portion of the first conduit can be disposed in the first interior volume forming a first flow path including the first drain, and a portion of the second conduit can be disposed in the second interior volume forming a second flow path including the second drain. The capture element can be detachably attached to the first conduit and disposed in fluidic communication with the first flow path. A first shortest distance between the second opening of the first conduit and the second opening of the second conduit is shorter than a second shortest distance between the first drain and the second drain. In any embodiment, the kit further can comprise a capture element configured to detachably attach to one of the plurality of conduits such that, when detachably attached to the conduit, the first capture element is disposed in fluidic communication with a liquid flow path.

In yet another aspect, the present disclosure provides a kit. The kit can comprise a first body comprising a plurality of spaced-apart conduits, a second body configured to be operably coupled to the first body, and a capture element. The conduits can be configured in a linear array. The plurality of conduits can comprise a first conduit having a first opening and a second opening and a second conduit adjacent the first conduit, the second conduit having a first opening and a second opening. The second body can comprise a plurality of spaced-apart chambers; each chamber having conduit-receiving opening, an interior volume, and a drain. The plurality of spaced-apart chambers can comprise a first chamber having a first interior volume and a first drain and a second chamber adjacent the first chamber, the second chamber having a second interior volume and a second drain. When the first body and the second body are operably coupled, a portion of the first conduit can be disposed in the first interior volume forming a first flow path including the first drain, and a portion of the second conduit can be disposed in the second interior volume forming a second flow path including the second drain. The capture element can comprise a capture element depth and can be configured to detachably attach to the first conduit in a manner that places the capture element in fluidic communication with the first flow path. The assembly can have a third shortest distance between the second opening of a conduit and the floor of the receiving chamber in which the portion of the conduit is disposed, wherein in the capture element depth is longer than the third shortest distance.

In any of the above embodiments, the kit further can comprise a third body, wherein the third body comprises a plurality reservoirs, each reservoir comprising an outlet and the plurality of outlets forming a linear array, wherein the plurality of outlets comprises a first outlet and a second outlet wherein, when operably coupled to the first body of the assembly, the first outlet is placed in fluidic communication with the first conduit and the second outlet is placed in fluidic communication with the second conduit. In any of the above embodiments, the kit further can comprise a lysis reagent or a reagent for detecting a biomolecule.

In yet another aspect, the present disclosure provides a method of detecting a presence or an absence of an analyte in a liquid sample. The method can comprise contacting the liquid sample with a capture element detachably attached to a conduit in any one of the assemblies of the present disclosure, detaching the capture element from the assembly, and detecting a presence or an absence of an analyte retained from the sample by the capture element.

The words "preferred" and "preferably" refer to embodiments of the invention that may afford certain benefits, under certain circumstances. However, other embodiments may also be preferred, under the same or other circumstances. Furthermore, the recitation of one or more preferred embodiments does not imply that other embodiments are not useful, and is not intended to exclude other embodiments from the scope of the invention.

The terms "comprises" and variations thereof do not have a limiting meaning where these terms appear in the description and claims.

As used herein, "a," "an," "the," "at least one," and "one or more" are used interchangeably. Thus, for example, a microorganism can be interpreted to mean "one or more" microorganisms.

The term "and/or" means one or all of the listed elements or a combination of any two or more of the listed elements.

Also herein, the recitations of numerical ranges by endpoints include all numbers subsumed within that range (e.g., 1 to 5 includes 1, 1.5, 2, 2.75, 3, 3.80, 4, 5, etc.).

The above summary of the present invention is not intended to describe each disclosed embodiment or every implementation of the present invention. The description that follows more particularly exemplifies illustrative embodiments. In several places throughout the application, guidance is provided through lists of examples, which examples can be used in various combinations. In each instance, the recited list serves only as a representative group and should not be interpreted as an exclusive list.

Additional details of these and other embodiments are set forth in the accompanying drawings and the description below. Other features, objects and advantages will become apparent from the description and drawings, and from the claims.

DETAILED DESCRIPTION

Figure 1:
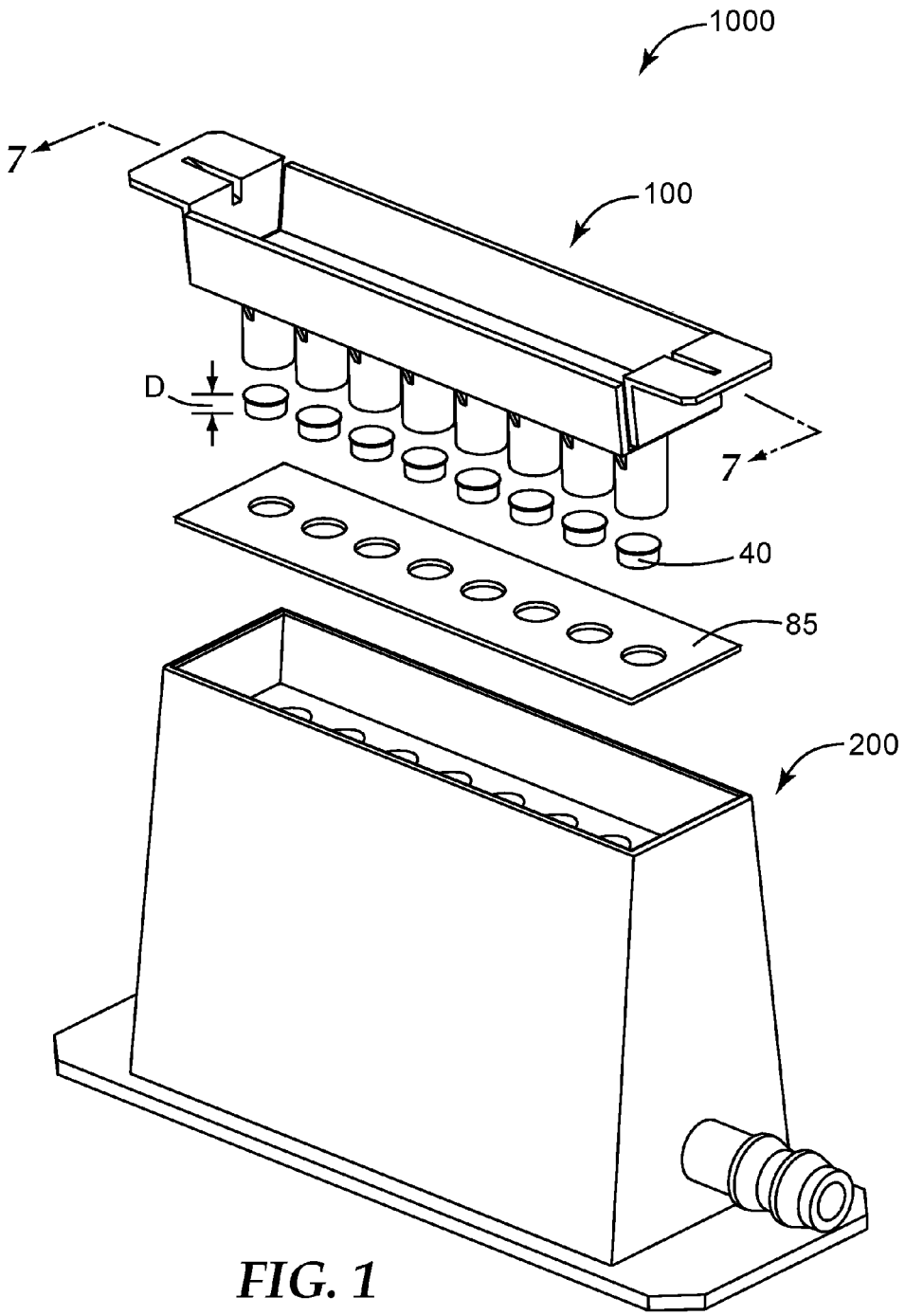
FIG. 1 is a perspective view of one embodiment of an assembly having a first body and second body according to the present disclosure.

Before any embodiments of the present disclosure are explained in detail, it is to be understood that the invention is not limited in its application to the details of construction and the arrangement of components set forth in the following description or illustrated in the following drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless specified or limited otherwise, the terms "connected" and "coupled" and variations thereof are used broadly and encompass both direct and indirect connections and couplings. Further, "connected" and "coupled" are not restricted to physical or mechanical connections or couplings. It is to be understood that other embodiments may be utilized and structural or logical changes may be made without departing from the scope of the present disclosure. Furthermore, terms such as "front," "rear," "top," "bottom," and the like are only used to describe elements as they relate to one another, but are in no way meant to recite specific orientations of the apparatus, to indicate or imply necessary or required orientations of the apparatus, or to specify how the invention described herein will be used, mounted, displayed, or positioned in use.

The present disclosure generally relates to preparing a sample to detect the presence or absence of an analyte. In particular, the present disclosure provides an assembly and a method to capture and concentrate the analyte for subsequent analysis and to easily transfer the captured analyte to a vessel for subsequent analysis. Advantageously, the analyte capture may be accomplished with the assembly using just one or two steps. The resulting captured analyte is relatively concentrated, relatively free of impurities, and is suitable for use in a variety of detection methods (e.g., immunodetection methods and nucleic acid detection methods). In addition, the inventive assembly of the present disclosure substantially reduces the possibility of cross-contamination between two or more liquid streams passing through the assembly and/or analyte capture elements detachably attached to the assembly. Moreover, the inventive assembly is configured such that, if the operator inadvertently attempts to detach an analyte capture element prematurely, the assembly still functions to capture the analyte and the analyte capture element(s) can be retrieved for subsequent detection of the analyte.

The present disclosure includes methods and an assembly for processing (e.g., simultaneously or sequentially) a plurality of samples. The inventive methods relate to the detection of an analyte in a sample. In any embodiment, the analyte can be a biological analyte such as, for example, a biological analyte that indicates the presence of a microorganism in the sample.

The plurality of samples may comprise samples from independent sources. Alternatively or additionally, the samples may comprise samples obtained from a single source (e.g., replicate sample; samples removed at different time points; replicate samples that were subjected to different treatments). The inventive methods relate to the detection of an analyte in a sample. In any embodiment, the analyte can be a biological analyte such as, for example, a biological analyte that indicates the presence of a microorganism in the sample.

The sample can be any sample that may comprise an analyte. The analyte may comprise a chemical analyte and/or a biological analyte. Nonlimiting examples of suitable samples include suspensions or cultures of cells (e.g., mammalian cells, insect cells, yeast cells, filamentous fungi, bacterial cells), environmental samples (e.g., surface swabs), food (e.g., raw materials, in-process samples, and finished-product samples), beverages, clinical samples (e.g., blood, urine, sputum, tissue, mucous, feces, wound exudate, pus), and water (e.g., surface water, potable water, process water).

Non-limiting examples of suitable biological analytes include nucleic acids (e.g., a polynucleotide associated with a particular type of cell or microorganism) or detectable antigens (e.g., proteins, oligopeptides, enzymes, endotoxin, cell membrane components, and cell wall components). Analytical procedures to detect the biological analytes are known in the art. Preferred biological analytes to be detected include nucleic acids that are capable of being amplified in a reaction (e.g., PCR), for example.

Besides fluid samples, other test samples may include liquids as well as solid(s) dissolved or suspended in a liquid medium. Samples of interest may include process streams, water, soil, plants or other vegetation, air, surfaces (e.g., contaminated surfaces), and the like. Samples can also include cultured cells. Samples can also include samples on or in a device comprising cells, spores, or enzymes (e.g., a biological indicator device).

Solid samples may be disintegrated (e.g., by blending, sonication, homogenization) and may be suspended in a liquid (e.g., water, buffer, broth). In some embodiments, a sample-collection device (e.g., a swab, a sponge) containing sample material may be used in the method. Alternatively, the sample material may be eluted (e.g., rinsed, scraped, expressed) from the sample-collection device before using the sample material in the method. In some embodiments, liquid or solid samples may be diluted in a liquid (e.g., water, buffer, broth).

Suitable samples also include cell-suspension media (e.g., culture broth, semi-solid cell culture media, and tissue culture media, filtrate) that contain cells or previously contained cells. Suitable samples also include cell lysates. Cell lysates may be produced by chemical means (e.g., detergents, enzymes), mechanical means (sonic vibration, homogenization, French Press), or by other cell lytic means known in the art.

Microorganisms (e.g., bacteria, fungi, viruses) are a source of detectable analytes. Microorganisms can be analyzed in a test sample that may be derived from a variety of sources, as described herein. Microorganisms of particular interest include prokaryotic and eukaryotic organisms, particularly Gram positive bacteria, Gram negative bacteria, fungi, protozoa, mycoplasma, yeast, viruses, and even lipid-enveloped viruses. Particularly relevant organisms include members of the family Enterobacteriaceae, or the family Micrococcaceae or the genera *Staphylococcus* spp., *Streptococcus* spp., *Pseudomonas* spp., *Enterococcus* spp., *Salmonella* spp., *Legionella* spp., *Shigella* spp. *Yersinia* spp., *Enterobacter* spp., *Escherichia* spp., *Bacillus* spp., *Listeria* spp., *Vibrio* spp., *Corynebacteria* spp. as well as herpes virus, *Aspergillus* spp., *Fusarium* spp., and *Candida* spp. Particularly virulent organisms include *Staphylococcus aureus* (including resistant strains such as Methicillin Resistant *Staphylococcus aureus* (MRSA)), *S. epidermidis, Streptococcus pneumoniae, S. agalactiae, S. pyogenes, Enterococcus faecalis*, Vancomycin Resistant *Enterococcus* (VRE), Vancomycin Resistant *Staphylococcus aureus* (VRSA), Vancomycin Intermediate-resistant *Staphylococcus aureus* (VISA), *Bacillus anthracis, Pseudomonas aeruginosa, Escherichia coli, Aspergillus niger, A. fumigatus, A. clavatus, Fusarium solani, F. oxysporum, F. chlamydosporum, Listeria monocytogenes, Listeria ivanovii, Campylobacter* species, *Vibrio cholera, V. parahemolyticus, Salmonella cholerasuis, S. typhi, S. typhimurium, Candida albicans, C. glabrata, C. krusei, Enterobacter sakazakii, E. coli* O157 and multiple drug resistant Gram negative rods (MDR).

Gram positive and Gram negative bacteria are of particular interest. Of even more interest are Gram positive bacteria, such as *Staphylococcus aureus*. Also, of particular interest are antibiotic resistant microbes including MRSA, VRSA, VISA, VRE, and MDR.

In order to facilitate a complete understanding, the remainder of the detailed description describes apparatuses and assemblies for processing a sample by reference to the drawings, wherein like elements among the embodiments are referenced with like numerals throughout the following description. Turning to the drawings, FIG. 1 shows an exploded view of one embodiment of an assembly 1000 for processing a sample. The assembly 1000 comprises a first body 100, a second body 200 operationally coupled to the first body 100, and an analyte capture element 40 detachably attached to the first body 100. The analyte capture element 40 has a depth dimension "D" discussed below.

Figure 2:
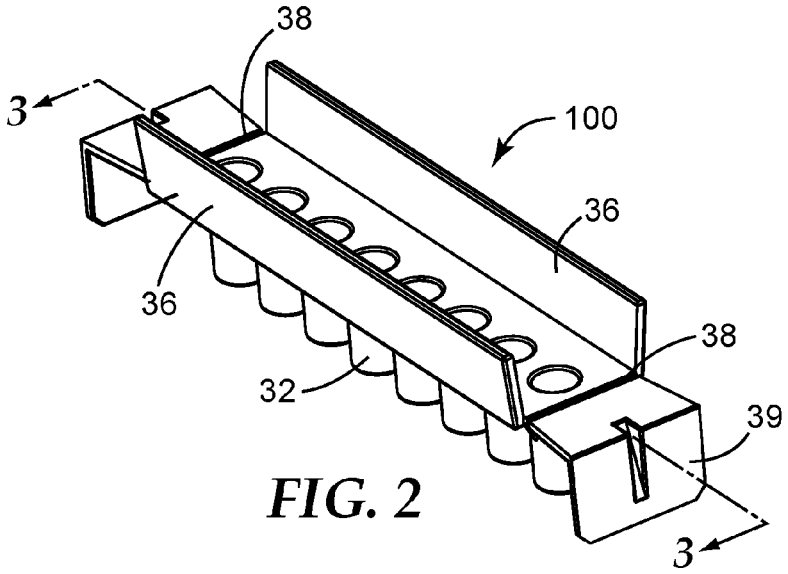
FIG. 2 is a perspective view of the first body of FIG. 1.
Figure 3:
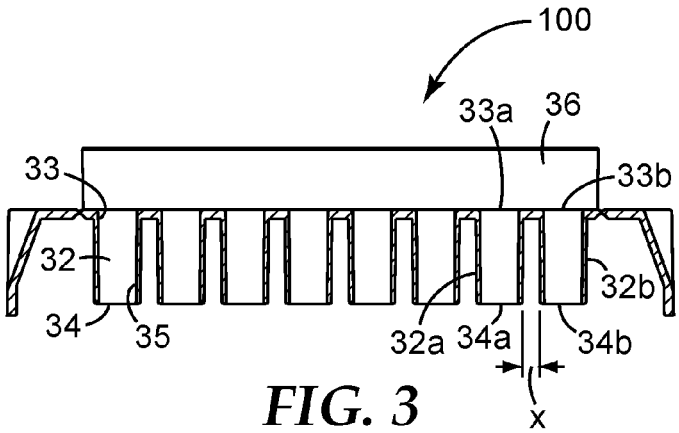
FIG. 3 is a cross-sectional view of the first body of FIG. 2.

As shown in FIGS. 1 through 3, the first body 100 comprises a plate 31 with a plurality of hollow conduits 32 attached thereto. In some embodiments, the conduits 32 form an array (e.g., a linear array). Each conduit 32 comprises a first opening 33, a second opening 34, and an interior volume defined by one or more walls 35. The plurality of conduits 32 comprises a first conduit 32*a* and a second conduit 32*b* adjacent the first conduit 32*a*. Conduit 32*a* and conduit 32*b* each has a first opening (openings 33*a* and 33*b*, respectively) and a second opening (openings 34*a* and 34*b*, respectively).

Optionally, the first body 100 may comprise one or more body wall. The one or more body wall may facilitate alignment of the first body 100 with the second body 200. In addition, the one or more body wall may facilitate the formation of a seal (e.g., a substantially liquid-tight seal and/or a seal that permits the accumulation of negative air pressure in the second body 200) between the first body 100 and the second body 200. The first body 100 of the illustrative embodiment of FIG. 3 comprises two longitudinal body walls 36 that are aligned parallel to the array of conduits 32 and two lateral body walls 37 that are aligned perpendicular to the longitudinal body walls 36. Optionally, any or all of the one or more body walls (36 and/or 37, respectively) may be coupled to the first body 100 via a foldable hinge 38.

The first body 100 is configured to receive the liquid sample, capture a biological analyte, if present in the liquid sample, and to direct the remainder of the liquid sample into the second body 200. The second body 200 is configured to receive the remainder of the liquid sample from the first body 100. Advantageously, the second body 200 is configured to reduce the probability of cross-contamination between samples.

Figure 4A:
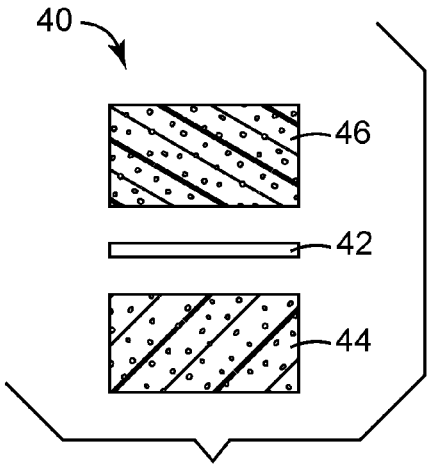
FIGS. 4A and 4B show exploded side views of two embodiments of an analyte capture element according to the present disclosure.
Figure 4B:
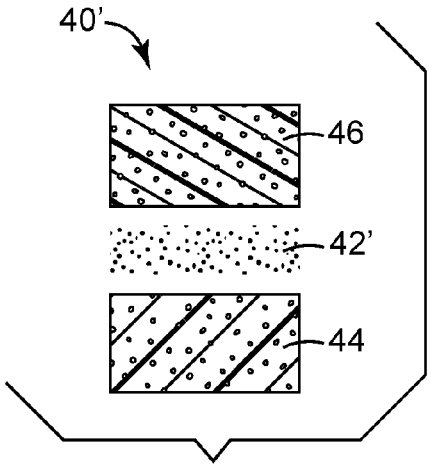

The assembly 1000 of the present disclosure further comprises an analyte capture element. FIGS. 4A and 4B show exploded side views of two embodiments of an analyte capture element (analyte capture elements 40 and 40', respectively) according to the present disclosure. The analyte capture element 40 can comprise a capture medium (capture medium 42 and/or capture medium 42'), as described herein. An analyte capture element 40 is detachably attached to a conduit 32 of the first body 100. In some embodiments, the analyte capture element may be disposed in the conduit 32, as shown in FIG. 1. The capture medium (42 and 42') comprises a material configured to capture and retain a target analyte (e.g., a microorganism or a biological analyte derived from a microorganism).

In some embodiments, the capture medium 42 comprises a porous sheet material (e.g., a filter membrane) that permits the passage of liquids there through but retains particles of a selected size and/or chemical or antigenic composition (e.g., particles that are approximately the size of bacteria such as about 0.5 to about 5 μm, for example). In these embodiments, the capture medium 42 can be one or more of a variety of membrane-type filters (e.g., cellulose acetate filters, nylon filters, nitrocellulose filters, polycarbonate filters, ceramic filters), for example. Non-limiting examples of suitable membrane-type filters are the VERSAPOR 3000TN membrane (3 μm nominal porosity) and the VERSAPOR 800 membrane (0.8 μm nominal porosity), both available from Pall Life Sciences, Port Washington, N.Y.).

In some embodiments (not shown), the analyte-capture element 40 may comprise a particulate material (e.g., a fiber, a particle, such as the particulate capture medium 42' of FIG. 4B, for example) or a nonporous sheet material (e.g., a polymer film such as the capture medium 42 of FIG. 4A, for example) configured to bind to a target analyte. The particulate or sheet materials may be disposed between two layers of the capture medium 42, as described above. In some embodiments, the particulate material may be porous. In some embodiments, the particulate material may be nonporous. In some embodiments, the analyte-capture element 40 may comprise a combination of porous and nonporous particulate materials. In some embodiments, the particulate material may bind the target analyte relatively non-specifically. Certain particulate cell concentration agents are known in the art and are suitable for use in methods of the present disclosure. Nonlimiting examples of suitable cell concentration agents include activated charcoal, hydroxyapatite (Berry et al.; Appl. Environ. Microbiol.; 63:4069-4074; 1997), magnetic beads (Oster et al., J. Magnetism and Magnetic Mat.; 225:145-150; 2001), ferrimagnetic mineral, magnetite, chitosan, and affinity supports. The use of compositions including an immobilized-metal support material to capture or concentrate microorganisms from a sample is described in PCT Publication No. WO2008/134472, entitled "COMPOSITIONS, METHODS, AND DEVICES FOR ISOLATING BIOLOGICAL MATERIALS", which is incorporated herein by reference in its entirety.

Exemplary particulate materials further include diatomaceous earth and surface treated diatomaceous earth. Specific examples of such concentration agents can be found in commonly assigned PCT Publication No. WO2009/046191, entitled "MICROORGANISMS CONCENTRATION PROCESS AND AGENT"; the disclosure of which is incorporated herein by reference. When dispersed or suspended in water systems, inorganic materials exhibit surface charges that are characteristic of the material and the pH of the water system. The potential across the material-water interface is called the "zeta potential," which can be calculated from electrophoretic mobilities (that is, from the rates at which the particles of material travel between charged electrodes placed in the water system). In an embodiment, concentration agents can have zeta potentials that are at least somewhat more positive than that of untreated diatomaceous earth, and the concentration agents can be surprisingly significantly more effective than untreated diatomaceous earth in concentrating microorganisms such as bacteria, the surfaces of which generally tend to be negatively charged.

Optionally, in any embodiment, the analyte capture element 40 may comprise a binding partner (e.g., a polyclonal antibody, a monoclonal antibody, a receptor, a lectin) coupled, either directly or indirectly, there to. For example, the analyte capture element 40 may comprise a capture medium 42 (e.g., a membrane) that includes functional groups to which an antibody is covalently or noncovalently attached. In some embodiments, the binding partner may provide the specificity to bind a particular target analyte. In some embodiments, not shown, the analyte capture element 40 may comprise a capture medium 42 comprising a plurality of layers. In some embodiments, the binding partner may be disposed (e.g., on and/or in a particle or a hydrogel) between two layers of the capture medium 42. As shown in the illustrated embodiment of FIG. 4A, the capture medium 42 may be supported on, sandwiched between, and/or coupled (e.g., via a heat bond, ultrasonic weld, or an adhesive) to a porous support 44 and/or a porous shield 46.

In some embodiments, the particulate material 42', which may comprise porous and/or nonporous particles, may comprise a binding partner coupled thereto and the binding partner may provide the specificity for binding a particular target analyte. In some embodiments, the particulate material may be incorporated into a matrix (e.g., beads entrapped in a fibrous matrix). Non-limiting examples of an analyte capture element comprising a particulate material sandwiched between two layers of porous material are described in PCT Publication No. WO2012/122088, which is incorporated herein by reference in its entirety.

Both porous supports 44 and the porous shield 46 can be made from a variety of porous materials such as, for example, cellulosic fibers, synthetic fibers (e.g., polymeric, glass), foams (e.g., open-cell foams such as, for example, polyurethane), and porous frits (e.g., glass, ceramic, polymeric) that permit the passage of liquid (e.g., an aqueous liquid) there through. Preferably, the porous shield 46, when present, comprises material with nominal porosity greater than about 5 μm, preferably greater than about 10 μm, so that microorganisms can pass freely through the material to the analyte-capture element 40. A non-limiting example of a material that may be used in a porous shield 46 is a polypropylene felt filter (part number NB005PPS2R, 5 μm nominal porosity, available from CUNO 3M, Meriden, Conn.).

The porous support 44, capture medium 42, and porous shield 46 are dimensioned such that they can be slideably inserted (e.g., by press-fit) into and releasably retained in the conduit 32 of the second body 200. In some embodiments (not shown), the capture medium 42 may be coupled (e.g., adhesively coupled, stitched, heat-bonded, ultrasonically welded, insert-molded) to the porous support 44 and/or the porous shield 46, provided the coupling means does not substantially prevent contact between a liquid sample and the capture medium 42 and/or substantially prevent the flow of a liquid sample through the analyte-capture element 40.

Figure 5:
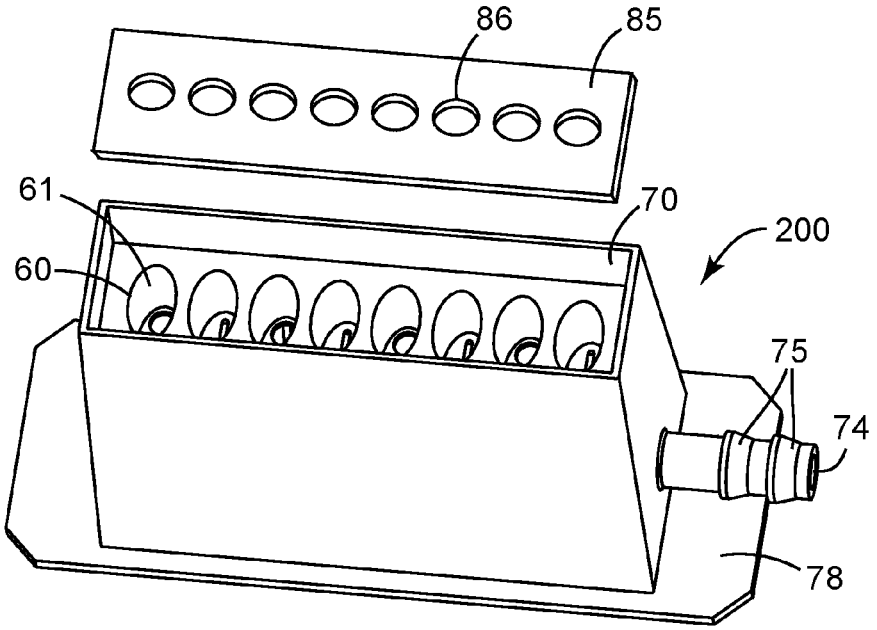
FIG. 5 is an upper perspective view of the second body and gasket of FIG. 1.
Figure 6:
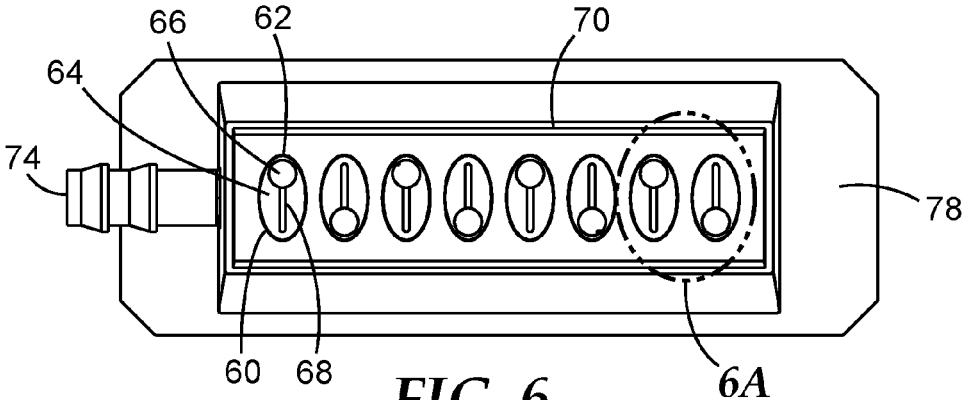
FIG. 6 is a top view of the second body of FIG. 5.

The assembly 1000 of the present disclosure comprises a second body 200 configured to be operationally coupled to the first body 100. When operationally coupled to the first body 100, the second body 200 can receive a liquid effluent from at least one of the plurality of conduits of the first body 100. FIG. 5 shows an upper perspective view and FIG. 6 shows a top view of one embodiment of a second body 200 according to the present disclosure. The second body 200 comprises a plurality of spaced-apart chambers 60. Preferably, the number of chambers 60 in the second body 200 corresponds to the number of conduits present in the first body 100 of the assembly 1000. The spacing and dimensions of the chambers 60 are selected such that the chambers 60 can receive liquid streams from at least two conduits 32 of the first body 100 and substantially prevent separate liquid streams passing through two or more conduits of the first body 100 from contacting each other.

The second body 200 optionally may comprise a flange 70. The flange 70 may be configured to form a tight fit with the first body of the assembly to facilitate a sufficient seal that permit vacuum suction to be transmitted from the second body 200 to the first body 100 of the assembly 1000. In addition, the flange 70 may position and, optionally, retain an optional gasket 85. The gasket 85 comprises holes 86 dimensioned to receive the conduits 32 of the first body 100. The gasket 85 can be fabricated from a conformable material (e.g., butyl rubber) and can facilitate the formation of a vacuum seal between the first body 100 and a second body 200 according to the present disclosure. Optionally, the second body 200 further may comprise a vent 74. The vent 74 may be adapted to be connected to a source of negative pressure (e.g., a vacuum pump). The adaptations may comprise for example, shaping and dimensioning the vent 74 so that it can be attached to a vacuum hose. In addition, the vent 74 may comprise ribs 75 to retain a vacuum hose. Optionally, the second body 200 may further comprise a receptacle base 78 to support the receptacle on a surface. Optionally, the second body may be fabricated from two or more coupleable parts (not shown) for ease of cleaning and/or re-use.

Each of the plurality of chambers 60 has at least one wall 61 defining a conduit-receiving opening 62. Optionally, the chamber further may comprise a floor 64. In some embodiments, the floor 64 may be substantially planar. The at least one wall 61 and, if present, optional floor 64 define an interior volume of the chamber 60. Each chamber 60 further comprises a drain 66, which is an opening to direct the flow of liquid (e.g., by gravity or by vacuum suction) out of the chamber 60. In the illustrated embodiment, the drains 66 are positioned in the floor 64 of the chamber 60. Optionally, the floor 64 further may comprise a trough 68 to direct the flow of liquid along the floor 64 to the drain 66. In an alternative configuration (not shown), the drain openings may be located in the walls of the chambers.

Figure 6A:
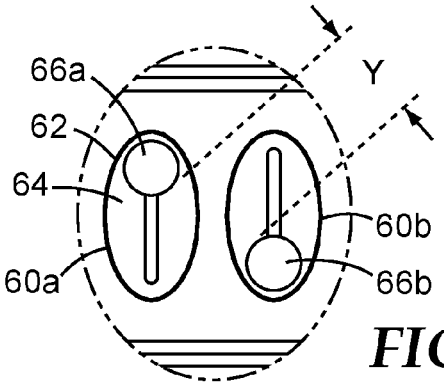
FIG. 6A is detailed plan view of two chambers of the second body of FIG. 6.

FIG. 6A shows a detailed top view of two adjacent chambers (60*a* and 60*b*, respectively) in the second body 200 of FIGS. 5 and 6. The chambers 60*a* and 60*b* each have a conduit-receiving opening 62, floor 64, drain (66*a* and 66*b*, respectively), and trough 68. There exists a minimum distance ("Y") between two adjacent drains (e.g., 66*a* and 66*b*, respectively).

The second body 200 can be fabricated by injection molding, for example, from polymeric material (e.g., polyethylene, polypropylene, polystyrene, polycarbonate). Alternatively, the second body 200 can be fabricated using glass or metal.

Figure 7:
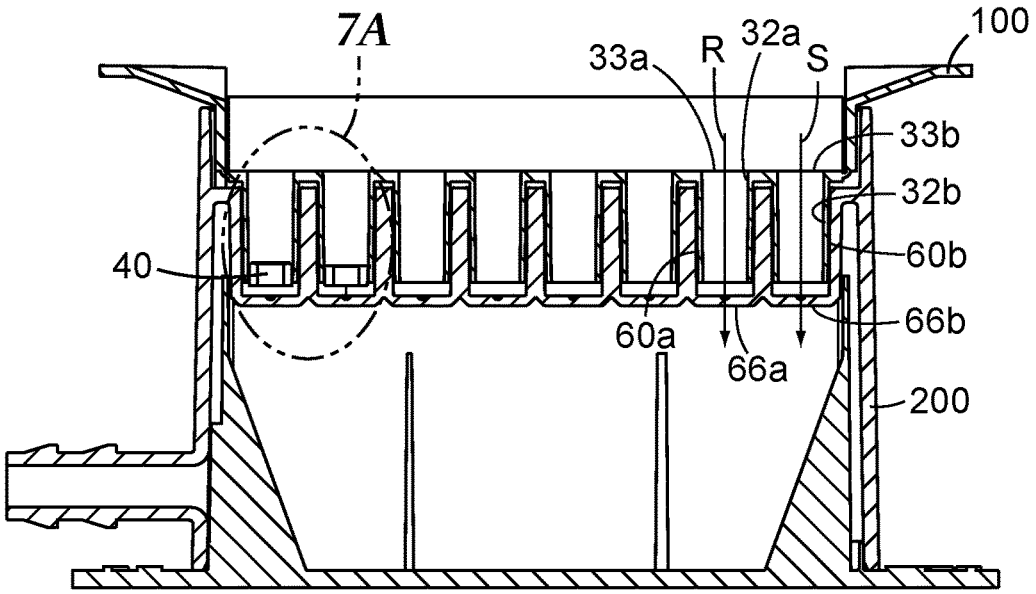
FIG. 7 is a cross-sectional view of one embodiment of an assembly comprising a first body operationally coupled to a second body, according to the present disclosure.
Figure 7A:
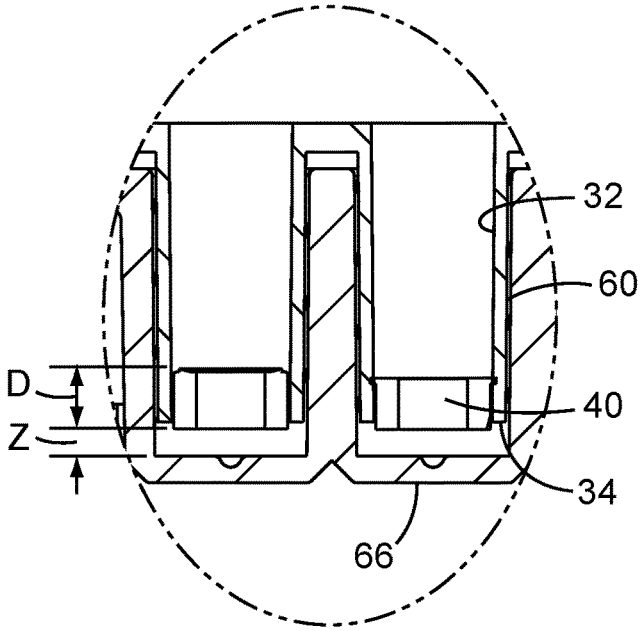
FIG. 7A is a detailed view of two chambers of FIG. 7.

The assembly of the present disclosure comprises a first body operationally coupled to a second body. The first body is configured to receive a liquid sample; to direct the liquid sample into contact with an analyte capture element in order to capture an analyte, if present, from the sample; and to direct the non-analyte portion of the sample into the second body. Referring back to the drawings, FIG. 7 shows a cross-sectional view of one embodiment of an assembly 1000 comprising a first body 100 operationally coupled to a second body 200, according to the present disclosure.

When the first body 100 and the second body 200 are operably coupled, a portion of a first conduit (e.g., conduit 32*a*) may be disposed in an interior volume of a first chamber (e.g., chamber 60*a*), forming a first flow path (shown by arrow "R") extending at least from a first opening (e.g., first opening 33*a* of conduit 32*a*) to a first drain (e.g., drain 66*a* of the first chamber 60*a*). In addition, when the first body 100 and the second body 200 are operably coupled, a portion of a second conduit (e.g. conduit 32*b*) adjacent the first conduit may be disposed in an interior volume of a second chamber (e.g., chamber 60*b*) adjacent the first chamber, forming a second flow path (e.g., shown by arrow "S") extending at least from a first opening (e.g., first opening 33*b* of conduit 32*b*) to a second drain (e.g., drain 66*b* of second chamber 60*b*). In addition, when the first body 100 and second body 200 are operationally coupled, a first shortest distance between the second opening of the first conduit (e.g., conduit 32*a*) and the second opening of the second conduit (e.g., conduit 32*b*) adjacent the first conduit is shorter than a second shortest distance between the first drain (e.g., drain 66*a*) and the second drain (e.g., drain 66*b*) adjacent the first drain.

As shown in FIG. 1, the analyte capture element has a depth "d" extending in the direction of the flow path. Also shown in FIG. 7, there is a third shortest distance "Z" extending from the second opening 34 of a conduit 32 and the floor 64 of the chamber 60 in which a portion (e.g., the second opening) of the conduit 32 is disposed. In one embodiment, the third shortest distance "Z" is shorter than the depth "D" of the analyte capture element 40. Advantageously, this configuration may substantially prevent the unintentionally complete ejection of the analyte capture element 40 from the conduit 32 during the passage of a liquid sample through the analyte capture element 40. Furthermore, if the analyte capture element is partially ejected from the conduit 32 during use (not shown), the presence of a trough (described above) in the chamber 60 can prevent a vacuum lock from forming and permit the operator to process the entire liquid sample even though the analyte capture element has partially ejected from the conduit.

Figure 8:
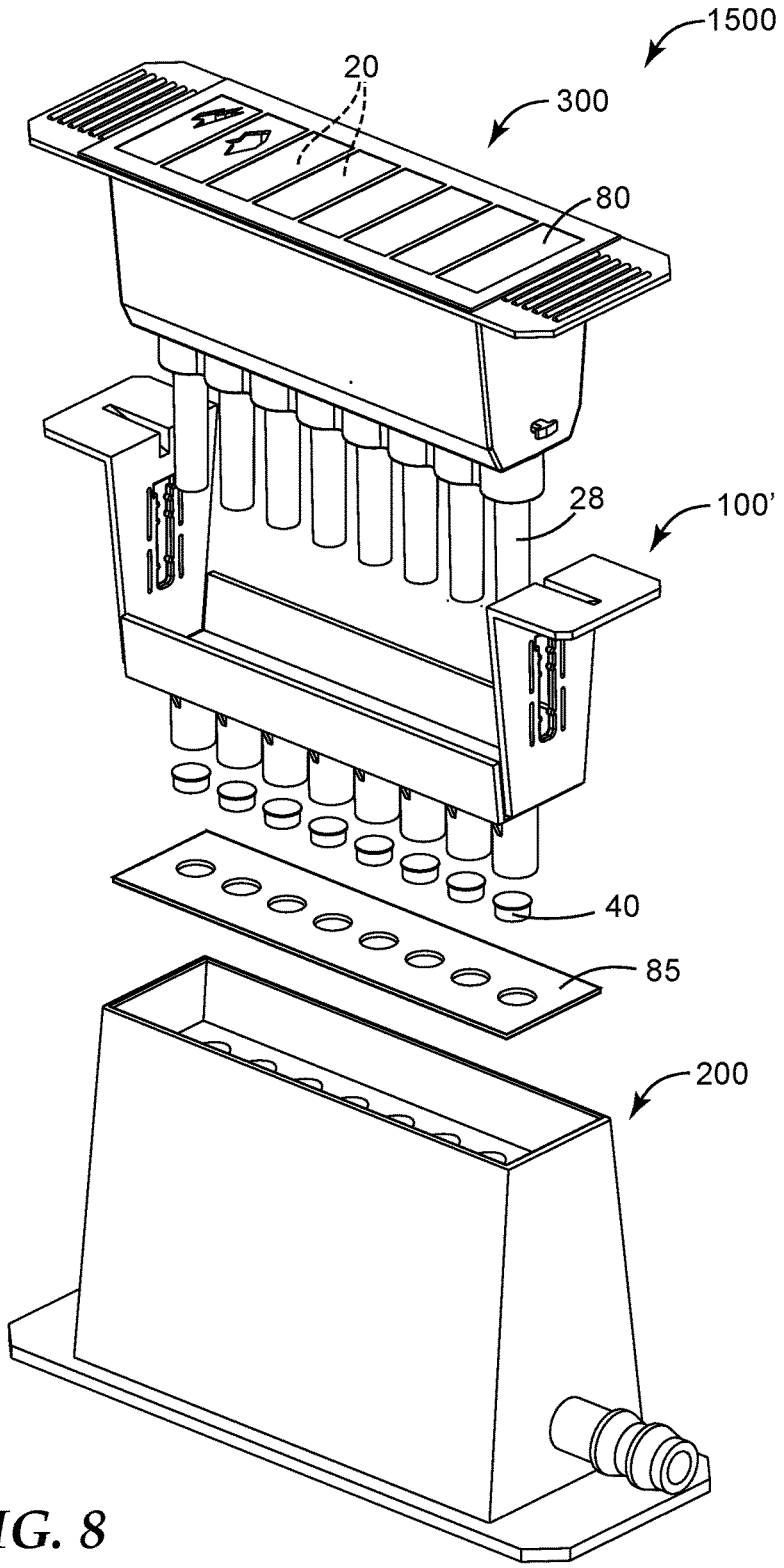
FIG. 8 is an exploded view of one embodiment of an assembly comprising a first body, a second body, and one embodiment of an optional third body according to the present disclosure.
Figure 9:
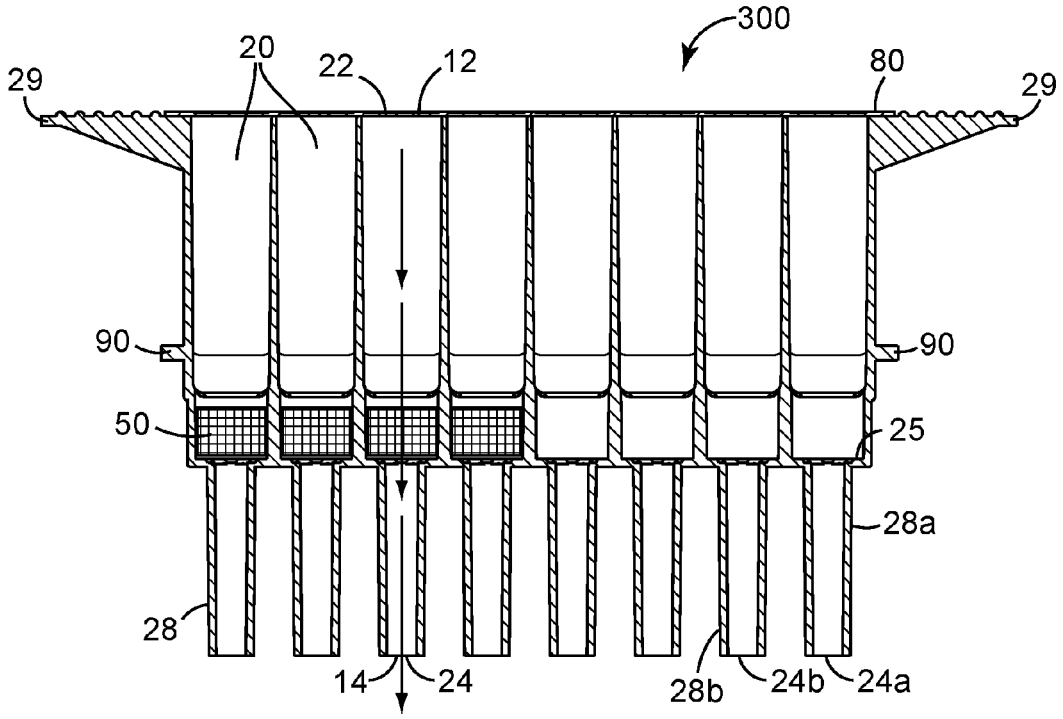
FIG. 9 is a cross-sectional view of the third body of FIG. 8

In any embodiment, an assembly of the present disclosure further can comprise a third body operationally coupled to the first body. FIG. 8 shows an exploded view of one embodiment of an assembly 1500 comprising a first body 100', a second body 200, and a third body 300 according to the present disclosure. The assembly 1500 comprises a first body 100' comprising a plurality of conduits 32, as described herein. The assembly 1500 further comprises a second body 200 comprising a plurality of chambers 60, as described herein and shown in FIGS. 5, 6, and 6A, for example. In addition, the assembly 1500 comprises a third body 300. FIG. 9 shows a cross-sectional view of the third body 300 of FIG. 8.

The third body 300 has a first end 12 and a second end 14 opposite the first end 12. The third body 300 comprises a plurality of spaced-apart reservoirs 20. The reservoirs 20 may form an array such as a linear array of reservoirs 20, for example, as shown in FIGS. 8 and 9. Each reservoir 20 in the plurality of reservoirs comprises a sample-receiving opening 22 at the first end 12 of the third body 300 and an outlet 28 at the second end 14 of the third body 300. Each of the outlets 28 separately extends from the third body 300 and is shaped and dimensioned to be inserted at least partially into a corresponding conduit in the first body 100'.

The volume of the reservoirs 20 can be configured according to the typical size of a sample to be tested. In some embodiments, the volume of the reservoir 20 is at least about one milliliter. In some embodiments, the volume of the reservoir 20 is at least about five milliliters. In some embodiments, the volume of the reservoir 20 is at least about ten milliliters. In some embodiments, the volume of the reservoir 20 is at least about twenty-five milliliters. In some embodiments, the volume of the reservoir 20 is at least about one hundred milliliters. Larger volumes of liquid sample can be tested by passing two or more aliquots of the sample sequentially through the same reservoir 20.

Also shown in FIG. 8 is an optional cover 80. The cover 80 protects one or more reservoir 20 from the entry of undesirably material. In some embodiments, the cover 80 may comprise a thin sheet (e.g., a plastic film or coated paper). Preferably, the cover 80 is attached (e.g., removably attached) to the third body 300 via a heat bond or a pressure-sensitive adhesive, for example. In certain preferred embodiments, the cover 80 may comprise a pierceable film (e.g., pierceable by a pipette tip) and or the cover may be optically translucent or transparent, thereby permitting visualization of contents in the reservoirs 20.

FIG. 9 shows a cross-sectional view of the third body 300 of the assembly 1500 of FIG. 8. Each reservoir 20 in the plurality of reservoirs has an opening 22 through which a sample (e.g., a liquid sample or a suspension of solid material in a liquid, not shown) is deposited into the reservoir 20. Also shown in FIG. 9 is the discharge opening 24, through which a liquid sample is conveyed to the third body 300. Thus, the third body 300 of the present disclosure defines a liquid flow path (e.g., a liquid flow path), shown by the arrows, extending from the sample-receiving opening 22 at the first end 12 of the third body 300 to the discharge opening 24 at the second end 14 of the third body 300. Optionally, the third body 300 further may comprise one or more positioning elements 90. The positioning elements 90 extend out from the third body 300 so that they can engage corresponding (e.g., complementary-shaped) receivers (described below) to properly position the third body 300 relative to the first body 100 during use of the assembly 1500. Also shown in FIG. 9 are handles 29 and optional cover 80. The handles 29 can be grasped in order to urge the third body 300 and first body 100 together, as described herein.

The third body 300 can be fabricated by injection molding, for example, from polymeric material (e.g., polyethylene, polypropylene, polystyrene, and/or polycarbonate). Alternatively, the third body 300 can be fabricated using glass or metal.

The plurality of outlets 28 in the third body 300 of the present disclosure are spaced apart to reduce the probability of cross-contamination between adjacent flow paths of the third body 300 and/or liquid samples passing through adjacent flow paths in the assembly 1500. FIG. 9 shows a third body 300 comprising two adjacent outlets (outlets 28*a* and 28*b*, respectively). The adjacent conduits 28*a* and 28*b* each comprise a second opening (openings 24*a* and 24*b*, respectively).

Optionally, the third body 300 further may comprise a prefilter 50 disposed in the reservoir. The prefilter 50 serves to trap and substantially remove particulate materials that are larger than a bacterium (e.g., ≅5 μm diameter) that may be present in a liquid sample passing there through. The reservoir 20 is configured such that a liquid sample moving through the reservoir 20 from the sample-receiving opening 22 to the discharge opening 24 substantially passes through the prefilter 50. The prefilter 50 can be supported by the optional base 25. In some embodiments, the prefilter 50 optionally may be coupled (e.g., via an adhesive or other secural means, not shown) to the base 25.

The prefilter 50 can be constructed from a variety of materials known in the art (e.g., nonwoven materials comprising nylon, polypropylene, glass fibers, or cellulose acetate fibers, for example; or perforated films such as polycarbonate films, for example). In any embodiment, the prefilter 50 may comprise a single layer of material. In some embodiments, the prefilter 50 may comprise a plurality of layers (not shown). A layer of a prefilter comprising a plurality of layers may comprise a particulate material to facilitate the removal of certain non-analyte materials (e.g., fats, minerals) from the sample.

Figure 10:
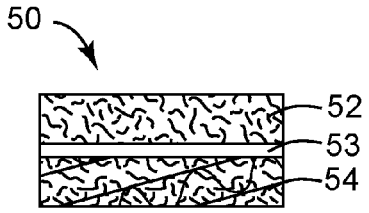
FIG. 10 is a side view of one embodiment of a prefilter having a plurality of layers according to the present disclosure.

FIG. 10 shows an exploded side view of one embodiment of a prefilter 50 having a plurality of layers. The prefilter 50 may comprise a first layer 52 that may comprise a membrane filter or a relatively coarse nonwoven depth filter (approximately 1 mm thick) made from polyethylene fibers. The prefilter 50 or layer thereof, may have a nominal porosity of approximately 20-50 μm and can function to prevent the passage of large particles into other layers of the prefilter, if present. The prefilter 50, or layer thereof, may comprise a wet-laid fibrous scaffold (second layer 53, approximately 0.2-1 mm thick), optionally containing particulate material that removes a one or more specific non-analyte materials. Layer 54 may comprise a filter material that functions substantially to remove particulate materials that are larger than a bacterium (e.g., about ≥5 μm diameter). A non-limiting example of a material that may be used in a prefilter 50 individually or in any combination with other materials is a polypropylene felt filter (part number NB005PPS2R, 5 μm nominal porosity, available from CUNO 3M, Meriden, Conn.). Other known layers (not shown) and/or materials may be used in prefilter 50, with each layer functioning to reduce the amount of non-analyte material in the liquid sample as it passes through the prefilter 50.

Figure 11:
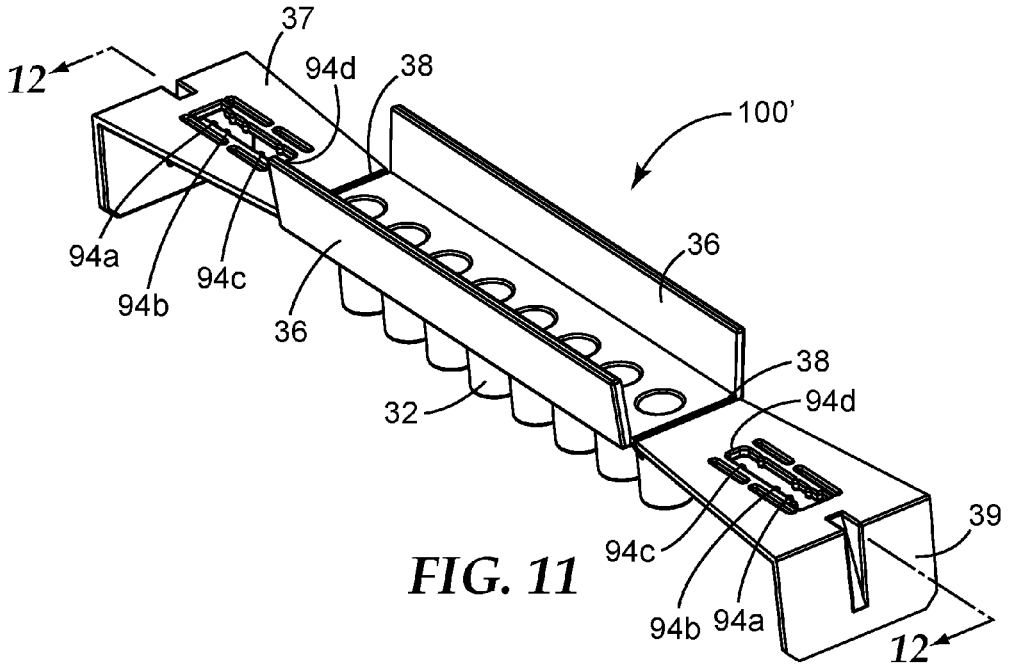
FIG. 11 is an upper perspective view of an alternative embodiment of a first body according to the present disclosure.
Figure 12:
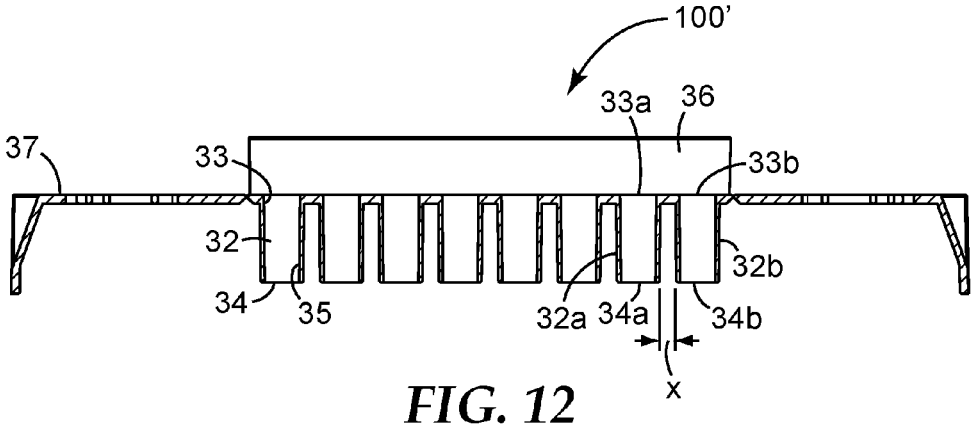
FIG. 12 shows a cross-sectional view of the first body of FIG. 11.

In an assembly 1500 of the present disclosure, the third body 300 is operatively coupled to the first body 100. FIG. 11 shows an upper perspective view of a first body 100' of the assembly 1500 of FIG. 8. FIG. 12 shows a cross-sectional view of the first body 100' of FIG. 11.

The lateral body walls 37 further comprise a flap 39. The flap 39 can be grasped in order to urge the third body 300 and first body 100' together, thereby causing the outlets 28 of the third body 300 to traverse longitudinally through the conduits 32 of the first body 100'.

Optionally, one or more of the body walls (e.g., lateral body walls 37) may further comprise a positioning element receiver 92. The positioning element receiver 92 comprises an opening in the lateral body wall 37 that receives and releasably engages the positioning element 90 of the third body 300. Preferably, the positioning element receiver 92 comprises restrictors 94*a*, 94*b*, and 94*c*, respectively that define at least two operable positions for the third body 300 relative to the first body 100'.

Figure 13A:
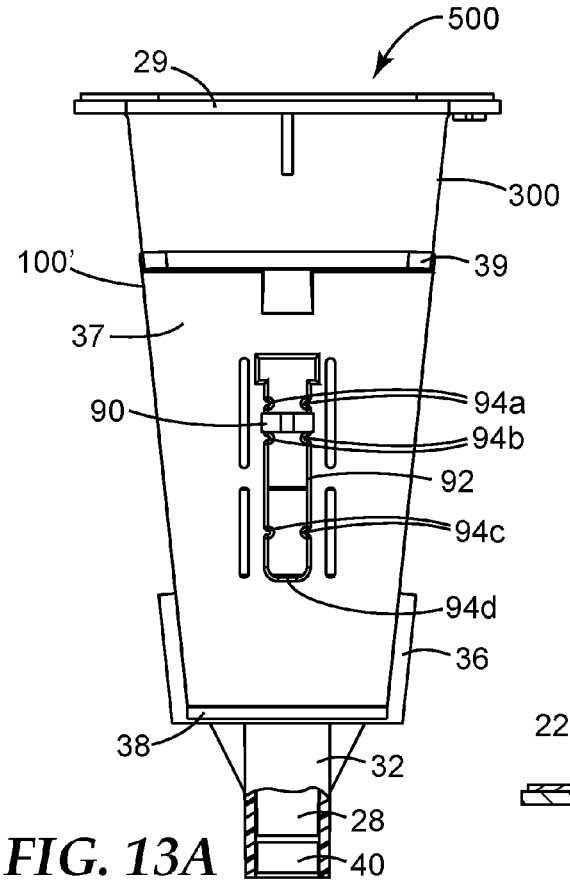
FIG. 13A is a side view, partially in section, of a subassembly comprising the third body of FIG. 9 operably coupled to the first body of FIG. 11 in a first operational position relative to each other.
Figure 13B:
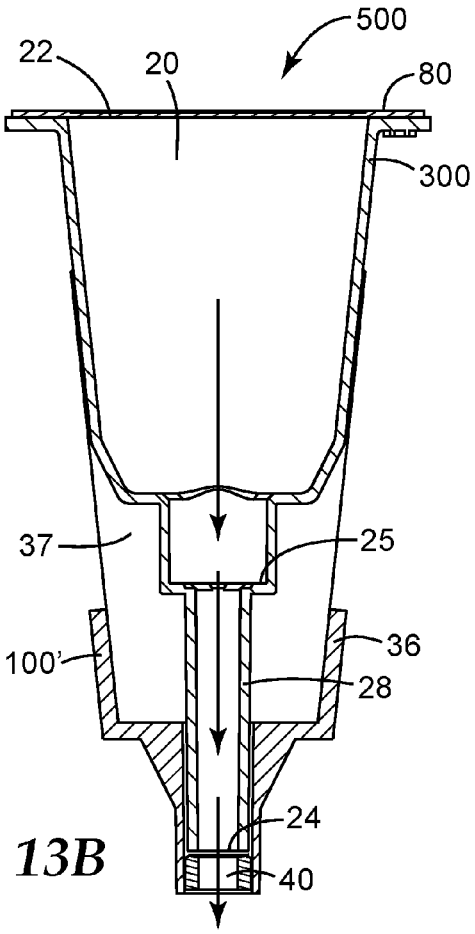
FIG. 13B is a cross-sectional view of the subassembly of FIG. 13A, showing the liquid flow path that passes through the third body and first body of the subassembly 500.

FIG. 13A shows a side view, partially in section, of a subassembly 500 of the assembly 1500 of FIG. 8. The subassembly 500 comprises the third body 300 of FIG. 9 operably coupled to the first body 100' of FIG. 11 in a first operational position. FIG. 13B shows a cross-sectional view of the subassembly 500 of FIG. 13A, showing the liquid flow path (arrows) that passes through the third body 300 and first body 100' of the subassembly 500. In the illustrated first operational position, positioning element 90 is releasably held in place, preferably in both lateral body walls 37 of the first body 100', by restrictors 94*a* and 94*b*. This operational position places a portion of the outlets 28 of the third body 300 in the conduits 32 of the first body 100' wherein the discharge openings 24 are disposed at a position proximate the analyte capture elements 40. In the first operational position, the handle 29 of the third body 300 is spaced apart from the flap 39 of the first body 100'.

Figure 13C:
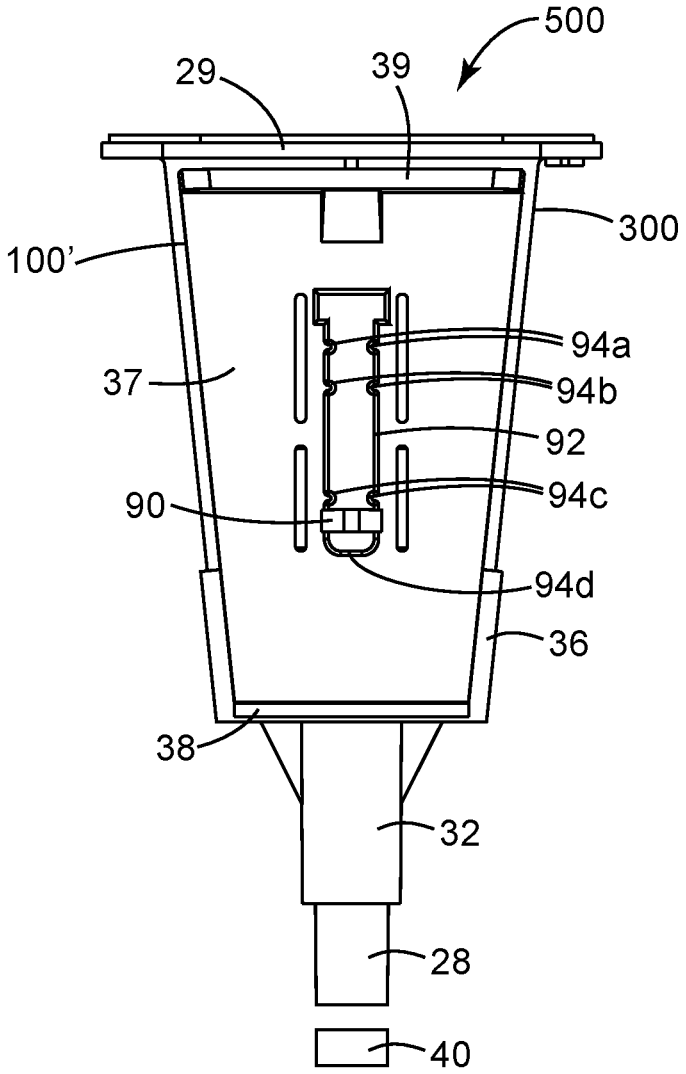
FIG. 13C is a side view of a subassembly comprising the third body of FIG. 9 operably coupled to the first body of FIG. 11 in a second operational position.

After a liquid sample (not shown) has passed through one or more flow path of the subassembly 500 of FIG. 13A-C, the analyte capture elements 40 can be ejected from the conduits 32 by moving the third body 300 to a second operational position relative to the first body 100'. FIG. 13C shows a side view of a subassembly 500 of the third body 300 of FIG. 9 operably coupled to the first body 100' of FIG. 11 in a second operational position. In this position, the positioning element 90 of the third body 300 has been moved to a position where its movement is restricted by restrictors 94*c* and 94*d*. Additionally, in this second operational position, at least a portion of the outlets 28 have traversed the length of the conduits 32 far enough (optionally, to a point beyond the second openings 34) to cause displacement of the analyte capture elements 40 from the conduits 32. It will be appreciated by a person having ordinary skill in the art that alternatively-shaped and dimensioned structures may be used to guide the positioning of the third body 300 relative to the first body 100'. It is also contemplated in an alternative embodiment (not shown), structures analogous to the positioning element 90 may be disposed on the first body 100' while structures analogous to the restrictors 94*a-d* may be disposed on the third body 300.

In use, the first body 100' may be positioned above one or more containers (e.g., a beaker, a microwell plate, or a plurality of tubes, not shown) to catch one or more analyte capture element 40 as it is ejected from the conduit 32. Optionally, each of one or more conduits may be releasably coupled (e.g., by friction fit, not shown) to the container prior to ejecting the analyte capture element(s). Preferably, the analyte capture elements are ejected into separate compartments or containers and subsequently are processed separately (e.g., to prevent cross-contamination) to detect an analyte.

In any embodiment, an assembly according to the present disclosure may further comprise one or more structures (not shown) to retain (e.g., releasably retain) the analyte capture element at a predetermined location (e.g., proximate the second opening) in a conduit. The retention structure(s) can be similar to the retention structures described in U.S. Patent Application No. 61/655,613, filed Jun. 5, 2012 and entitled "APPARATUS AND METHOD FOR PROCESSING A SAMPLE", which is incorporated herein by reference in its entirety. The retention structure(s) may be formed from the same material as the first body, optionally during a molding process that forms the first body. Alternatively, the retention structure(s) may be attached (e.g., via an adhesive, ultrasonic welding, or other means known in the art) after the first body is formed. When an analyte capture element is inserted into the conduit (e.g., via the second conduit opening), contact with the retention structure can provide resistance to further movement of the analyte capture element into the conduit. This resistance signals that the analyte capture element is properly positioned for use. A second retention structure can be provided to releasably retain the analyte capture element in a location (e.g., proximate the second opening of the conduit, not shown) in the conduit that is suitable for use, as described in U.S. Patent Application No. 61/655,613.

Any subassembly of the present disclosure, comprising a first body and a second body with an analyte capture element disposed in at least one of the plurality of conduits of the first body, can be used in an assembly for processing a sample.

Referring back to FIGS. 1-7, the present disclosure provides an assembly 1000 for processing a sample, according to the present disclosure. The assembly 1000 comprises a first body 100 comprising a plurality of conduits 32. The assembly 1000 further comprises a plurality of capture elements 40, each capture element releasably coupled with (e.g., slideably engaged in) one of the conduits 32. The assembly 1000 further comprises a second body 200 comprising a plurality of chambers 60 according to any one of the embodiments described herein.

The first body 100 comprises first and second conduits (e.g., 32*a* and 32*b*, respectively) each conduit comprising a second opening (openings 34*a* and 34*b*, respectively), as described herein. There exists in the assembly 1000 a first shortest distance between adjacent second openings (e.g., distance "X" between second openings 34*a* and 34*b*, respectively, shown in FIG. 5).

The second body 200 comprises a first chamber (e.g., chamber 60*a*) and a second chamber (e.g., chamber 60*b*) adjacent the first chamber, the first chamber (e.g., chamber 60*a*) having a first interior volume and the second chamber (e.g., chamber 60*b*) having a second interior volume. The first chamber 60*a* comprises a first drain (e.g., drain 66*a*, as shown in FIG. 6A, for example) and second the chamber 60*b* comprises a second drain (e.g., drain 66*b*, shown in FIG. 6A, for example). In addition, there exists in the assembly 1000 a second shortest distance between adjacent drains (e.g., distance "Y" between drains 66*a* and 66*b*, as shown in FIG. 6A.

In an embodiment of the assembly 1000, the first shortest distance (X) is shorter than the second shortest distance (Y). Advantageously, this configuration further reduces the probability of cross-contamination between separate liquid streams passing through (e.g., passing through either simultaneously or sequentially) the first outlet 28*a* and second outlet 28*b*, respectively, by causing greater physical separation of the liquid streams as they pass out of the respective drains.

Optionally, when the first body 100 and the second body 200 are operationally coupled, at least a portion of the first conduit 32*a* is disposed in the first interior volume of the first chamber 60*a* and at least a portion of the second conduit 32*b* is disposed in the second interior volume of the second chamber 60*b*. Advantageously, this configuration substantially can prevent cross-contamination of separate liquid streams passing through (e.g., passing through either simultaneously or sequentially) the first conduit 32*a* and second conduit 32*b*, respectively, or cross-contamination of analyte capture elements disposed in said adjacent conduits, by physically isolating the respective conduits (and analyte capture elements disposed therein) in separate chambers.

Optionally, in any embodiment of the assembly 1000, each of the plurality of chambers 60 may comprise a substantially planar floor, as described herein. In any embodiment of the assembly 1000, the floor may comprise the drain. In any embodiment of the assembly 1000, the floor further may comprise a trough, as described herein. In any embodiment of the assembly 1000, the second body 200 may be adapted to be coupled to a source of negative pressure, as described herein.

The present disclosure includes a method of detecting a presence or an absence of an analyte in a sample. The method comprises providing a liquid sample and an assembly according to the present disclosure, said assembly having at least one analyte capture element detachably attached to the first body (e.g., slideably engaged in a conduit of the first body) according to any of the embodiments described herein.

The method of the present disclosure further comprises contacting the liquid sample with the at least one analyte capture element. Typically, contacting the liquid sample with the at least one analyte capture element comprises loading the sample into a conduit of the first body (or a reservoir in fluidic communication with the conduit) that is in fluidic communication with the at least one analyte capture element and permitting the liquid sample to flow through the conduit to the second opening, and out of the conduit via the second opening into the second body. While flowing through the conduit, the liquid sample contacts (e.g., passes through) the analyte capture element. In some embodiments, the liquid sample can pass through the assembly by gravity flow. In some embodiments, the liquid can be urged to pass through the assembly by applying positive or negative pressure. Accordingly, in some embodiments, the method further can comprise the step of operably connecting the assembly (e.g., the second body of the assembly) to a source of negative pressure, as described herein.

In some embodiments, the at least one capture element comprises a porous medium. In these embodiments, contacting the liquid sample with the at least one capture element can comprise passing the liquid sample through the porous medium.

The method of the present disclosure further comprises detaching (e.g., by ejection; optionally, using an outlet of a third body to cause the ejection) the at least one analyte capture element from a conduit of the first body. Detaching the at least one analyte capture element can comprise sliding the capture element out of the second opening of a conduit. In some embodiments, an accessory tool (e.g., forceps, a pipette tip) may be used to grasp or pry the analyte capture element out of the conduit.

Referring back to FIG. 8, the present disclosure provides an assembly 1500 for processing a sample, according to the present disclosure. The assembly 1500 comprises a third body 300 comprising a plurality of reservoirs 20, each reservoir having an outlet 28 according to any one of the embodiments described herein. The assembly 1500 further comprises a first body 100' comprising a plurality of conduits 32, each conduit configured to receive an outlet 28. The assembly 1500 further comprises a plurality of capture elements 40, each capture element releasably coupled with (e.g., slideably engaged in) one of the conduits 32. The assembly 1500 further comprises a second body 200 comprising a plurality of chambers 60 according to any one of the embodiments described herein.

The first body 100' comprises first and second conduits (e.g., 32*a* and 32*b*, respectively), each conduit comprising a second opening (openings 34*a* and 34*b*, respectively), as described herein. There exists in the assembly 1500 a first shortest distance between adjacent second openings (e.g., distance "X" between second openings 34*a* and 34*b*, respectively, shown in FIG. 12).

The second body 200 comprises a first chamber (e.g., chamber 60*a*) and a second chamber (e.g., chamber 60*b*) adjacent the first chamber, the first chamber (e.g., chamber 60*a*) having a first interior volume and the second chamber (e.g., chamber 60*b*) having a second interior volume. The first chamber 60*a* comprises a first drain (drain 66*a*, as shown in FIG. 6A, for example) and second the chamber 60*b* comprises a second drain (drain 66*b*, shown in FIG. 6A, for example). In addition, there exists in the assembly 1500 a second shortest distance between adjacent drains (e.g., distance "Y" between drains 66*a* and 66*b*, as shown in FIG. 6A.

In an embodiment of the assembly 1500, the first shortest distance (X) is shorter than the second shortest distance (Y). Advantageously, this configuration further reduces the probability of cross-contamination between separate liquid streams passing through (e.g., passing through either simultaneously or sequentially) the first conduit 28*a* and second conduit 32*b*, respectively, by causing greater physical separation of the liquid streams as they pass out of the respective drains.

The third body 300 comprises a first reservoir (e.g., reservoir 20*a*) in fluidic communication with a first conduit (e.g., conduit 32*a*) of the first body 100' and a second reservoir (e.g., reservoir 20*b*) in fluidic communication with an adjacent second conduit (e.g., conduit 32*b*) of the first body 100'.

Optionally, when the third body 300, first body 100', and the second body 200 are operationally coupled, at least a portion of the first conduit 32*a* is disposed in the first interior volume of the first chamber 60*a* and at least a portion of the second conduit 32*b* is disposed in the second interior volume of the second chamber 60*b*. Advantageously, this configuration substantially can prevent cross-contamination of separate liquid streams passing through (e.g., passing through either simultaneously or sequentially) the first conduit 32*a* and second conduit 32*b*, respectively, or cross-contamination of analyte capture elements disposed in said adjacent conduits, by physically isolating the respective conduits (and analyte capture elements disposed therein) in separate chambers.

Optionally, in any embodiment of the assembly 1500, each of the plurality of chambers 60 may comprise a substantially planar floor, as described herein. In any embodiment of the assembly 1500, the floor may comprise the drain. In any embodiment of the assembly 1500, the floor further may comprise a trough, as described herein. In any embodiment of the assembly 1500, the second body 200 may be adapted to be coupled to a source of negative pressure, as described herein.

The present disclosure includes a method of detecting a presence or an absence of an analyte in a sample. The method comprises providing a liquid sample and an assembly according to the present disclosure, said assembly having at least one analyte capture element detachably attached to the first body (e.g., slideably engaged in a conduit of the first body) according to any of the embodiments described herein.

The method of the present disclosure further comprises contacting the liquid sample with the at least one analyte capture element. Typically, contacting the liquid sample with the at least one analyte capture element comprises loading the sample into a conduit of the first body (or a reservoir in fluidic communication with the conduit) that is in fluidic communication with the at least one analyte capture element and permitting the liquid sample to flow through the conduit to the second opening, and out of the conduit via the second opening into the second body. While flowing through the conduit, the liquid sample contacts (e.g., passes through) the analyte capture element. In some embodiments, the liquid sample can pass through the assembly by gravity flow. In some embodiments, the liquid can be urged to pass through the assembly by applying positive or negative pressure. Accordingly, in some embodiments, the method further can comprise the step of operably connecting the assembly (e.g., the second body of the assembly) to a source of negative pressure, as described herein.

In some embodiments, the at least one capture element comprises a porous medium. In these embodiments, contacting the liquid sample with the at least one capture element can comprise passing the liquid sample through the porous medium.

The method of the present disclosure further comprises detaching (e.g., by ejection; optionally, using an outlet of a third body to cause the ejection) the at least one analyte capture element from a conduit of the first body. Detaching the at least one analyte capture element can comprise sliding the capture element out of the second opening of a conduit. In some embodiments, an accessory tool (e.g., forceps, a pipette tip) may be used to grasp or pry the analyte capture element out of the conduit.

The method of the present disclosure further comprises detecting a presence or an absence an analyte retained from the sample by the analyte capture element. Optionally, before detecting the captured analyte, the analyte capture element may be rinsed or washed to remove interfering, non-analyte materials (e.g., protein, salt, etc.). Detecting the presence or absence of an analyte can comprise detecting the presence or absence of an analyte associated (e.g., exclusively associated) with a cell of interest (e.g., a microbial cell). The analyte may comprise a nucleotide (e.g., ATP), a nucleic acid (e.g., DNA, RNA, mRNA, and/or an oligonucleotide), an enzyme, or an antigen associated with a cell of interest. Thus, detecting a presence or an absence an analyte retained from the sample may comprise detecting a nucleotide, a nucleic acid, an enzyme, and/or an antigen associated with a cell of interest.

In any embodiment, the method further can comprise processing the at least one analyte capture element and/or sample material associated therewith to permeabilize a cell. Before and/or after the analyte capture element is ejected from the channel, the analyte capture element and, if present, any sample material associated therewith can be treated to permeabilize a cell. This can be performed, for example, by contacting the analyte capture element and/or sample material with a lysing agent (e.g., a detergent, an enzyme). After the capture element is ejected from the channel, the analyte capture element and, if present, any sample material associated therewith can be treated mechanically (e.g., by heat, sonication, freeze/thaw) to permeabilize a cell. Permeablizing the cells can improve the detection of an analyte associated with a cell of interest.

In any embodiment, the method further can comprise the step of coupling at least one conduit to a container. The container may be a reaction tube, for example, in which the analyte capture element can be processed to detect the presence or absence of an analyte. In these embodiments, ejecting the at least one analyte capture element from the channel can comprise ejecting the analyte capture element into the container. Advantageously, if the conduits are shaped and dimensioned to fit into a predetermined container (e.g., a reaction tube), this feature of the apparatus and method can substantially prevent contamination of the analyte capture element with materials that were not present in the sample.

It will be recognized by a person having ordinary skill in the art that the assemblies of the present disclosure can be used according to the method to process a plurality of samples. Optionally, the plurality of samples may be processed simultaneously.

In some embodiments, the analyte may be a whole microorganism such as a bacterium, for example. In some embodiments, the analyte may be a living microorganism. In these embodiments, it may be desirable to detect the microorganism by culture techniques. Accordingly, the microorganisms may be detached or eluted from the analyte-capture element by rinsing and/or homogenizing the analyte-capture element in a suspending medium (water, buffer, buffered saline, liquid culture media). The liquid suspending medium could be used to inoculate culture media (e.g., the appropriate agar culture medium) to determine the presence, absence or quantity of target microorganisms that were in the original sample. In some embodiments, the analyte-capture medium could be transferred directly onto culture media for growth and analysis. Accordingly, when the analyte-capture element is separated from the assembly by ejecting the analyte-capture element into a container, the container may include a suspending medium therein.

In some embodiments, the analyte may be a whole microorganism or a portion of a microorganism (e.g., a cell wall or a fragment thereof, a cell membrane or a fragment thereof, a protein, or a polysaccharide). In these embodiments, it may be desirable to detect the analyte using an immunodiagnostic method (e.g., ELISA, immunochromatography). Accordingly, when the analyte-capture element is separated from the apparatus by ejecting the analyte-capture element into a container, the container may include a suspending medium, a cell lysis reagent (e.g., an acid, a base, a detergent, an enzyme, a protease, lysozyme, lysostaphin), and/or an analyte-specific binding partner (e.g., an antibody, a receptor) therein.

In some embodiments, the analyte may be an enzyme or an enzyme substrate (e.g., ATP) associated with a particular microorganism or group of microorganisms. In these embodiments, it may be desirable to detect the analyte using an enzyme assay. Accordingly, when the analyte-capture element is separated from the apparatus by ejecting the analyte-capture element into a container, the container may include a suspending medium, a cell lysis reagent (e.g., an acid, a base, a detergent, an enzyme, a protease, lysozyme, lysostaphin), an enzyme (e.g., luciferase, adenylate kinase) and/or an enzyme substrate (e.g., a luciferin, a chromogenic enzyme substrate, or a fluorogenic enzyme substrate) therein.

In some embodiments, the analyte may be a microorganism-associated polynucleotide (e.g., DNA or RNA). In these embodiments, it may be desirable to detect the analyte using nucleic acid detection methods known in the art (e.g., PCR, rtPCR, LCR, NASBA, blot analysis). Accordingly, when the analyte-capture element is separated from the apparatus by ejecting the analyte-capture element into a container, the container may include a suspending medium, a cell lysis reagent (e.g., an acid, a base, a detergent, an enzyme, a protease, lysozyme, lysostaphin), an analyte-specific probe, an analyte-specific primer and/or an enzyme and a reagent for amplifying or labeling a polynucleotide therein.

In some embodiments, the method further can comprise an enrichment step. The enrichment step can comprise providing a culture medium to facilitate the growth of a target microorganism and a latent effervescent body comprising a selective agent, as described in PCT Publication No. WO2012/092123, which is incorporated herein by reference in its entirety.

The present disclosure also provides a kit for processing a sample. The kit can comprise any first body, second body, and second body according to the present disclosure to be used in a method of processing a sample according to the present disclosure. In some embodiments, the kit further may comprise one or more analyte capture elements configured to be releasably coupled with a conduit of the second body. In any embodiment, the kit further may comprise a reagent. The reagent may comprise a cell lysis agent, or a detection agent. The detection agent may comprise, for example, an oligonucleotide, a labeled oligonucleotide, an enzyme substrate, a binding partner (e.g., an antibody, a receptor), and/or a labeled binding partner.

EMBODIMENTS

Embodiment A is an assembly for processing a sample, comprising:

- a first body comprising a plurality of spaced-apart conduits, the conduits configured in a linear array;
  - wherein the plurality of conduits comprises:
    - a first conduit having a first opening and a second opening;
    - a second conduit adjacent the first conduit, the second conduit having a first opening and a second opening;
  - wherein the second body comprises a plurality of spaced-apart chambers; each chamber having conduit-receiving opening, an interior volume, and a drain;
  - wherein the plurality of spaced-apart chambers comprises:
    - a first chamber having a first interior volume and a first drain;

a second chamber adjacent the first chamber, the second chamber having a second interior volume and a second drain;

wherein, when the first body and the second body are operably coupled, a portion of the first conduit is disposed in the first interior volume forming a first flow path including the first drain, and a portion of the second conduit is disposed in the second interior volume forming a second flow path including the second drain; and a capture element detachably attached to the first conduit and disposed in fluidic communication with the first flow path;

wherein a first shortest distance between the second opening of the first conduit and the second opening of the second conduit is shorter than a second shortest distance between the first drain and the second drain.

Embodiment B is the assembly of Embodiment A, wherein each of the plurality of chambers comprises a floor, wherein the floor of each of the plurality of chambers comprises the drain.

Embodiment C is the assembly of Embodiment A or Embodiment B;

wherein the capture element comprises a capture element depth;

wherein the assembly has a third shortest distance between the second opening of a conduit and the floor of the receiving chamber in which the portion of the conduit is disposed;

wherein in the capture element depth is longer than the third shortest distance.

Embodiment D is an assembly for processing a sample, comprising:

a first body comprising a plurality of spaced-apart conduits, the conduits configured in a linear array;

wherein the plurality of conduits comprises:

a first conduit having a first opening and a second opening;

a second conduit adjacent the first conduit, the second conduit having a first opening and a second opening; a second body operably coupled thereto;

wherein the second body comprises a plurality of spaced-apart chambers; each chamber having conduit-receiving opening, an interior volume, and a floor comprising a drain;

wherein the plurality of spaced-apart chambers comprises:

a first chamber having a first interior volume and s first floor comprising a first drain;

a second chamber adjacent the first chamber, the second chamber having a second interior volume and a second floor comprising a second drain;

wherein, when the first body and the second body are operably coupled, a portion of the first conduit is disposed in the first interior volume forming a first flow path including the first drain, and a portion of the second conduit is disposed in the second interior volume forming a second flow path including the second drain; and a capture element detachably attached to the first conduit and disposed in fluidic communication with the first flow path, the capture element comprising a capture element depth;

wherein the assembly has a third shortest distance between the second opening of a conduit and the floor of the receiving chamber in which the portion of the conduit is disposed;

wherein in the capture element depth is longer than the third shortest distance.

Embodiment E is the assembly of Embodiment D, wherein a first shortest distance between the second opening of the first conduit and the second opening of the second conduit is shorter than a second shortest distance between the first drain and the second drain.

Embodiment F is the assembly of any one of Embodiments B through E, wherein the floor further comprises a trough extending along a portion of the floor to the drain.

Embodiment G is the assembly of any one of the preceding Embodiments, wherein at least a portion of the capture element is disposed in the first conduit.

Embodiment H is the assembly of Embodiment G, wherein the portion is disposed in the conduit proximate the second opening.

Embodiment I is the assembly of any one of the preceding Embodiments, further comprising a third body operably coupled to the first body of the assembly, wherein the third body comprises a plurality reservoirs, each reservoir comprising an outlet and the plurality of outlets forming a linear array, wherein the plurality of outlets comprises a first outlet and a second outlet wherein, when operably coupled to the first body of the assembly, the first outlet is placed in fluidic communication with the first conduit and the second outlet is placed in fluidic communication with the second conduit.

Embodiment J is the assembly of Embodiment I, wherein placing an outlet in fluidic communication with a conduit comprises inserting at least a portion of the outlet into the conduit.

Embodiment K is the assembly of Embodiment I or Embodiment J, wherein the first body or third body comprises a first positioning element configured to orient the third body in a predefined location with respect to the first body.

Embodiment L is the assembly of Embodiment J, wherein the first or third body further comprises a second positioning element configured to act cooperatively with the first positioning element to orient the third body in a predefined location with respect to the first body.

Embodiment M is the assembly of Embodiment L, wherein the second positioning element is configured to orient the third body at a plurality of predefined locations with respect to the first body.

Embodiment N is the assembly of any one of the preceding Embodiments, wherein the first body is adapted to sealingly couple to the second body and/or the second body is adapted to sealingly couple to the first body.

Embodiment O is the assembly of any one of the preceding Embodiments, wherein the two or more outlets of the first body are shaped, dimensioned, and spaced apart such that each outlet individually can be received by a container.

Embodiment P is the assembly of Embodiment O, wherein the container is a tube.

Embodiment Q is the assembly of any one of the preceding Embodiments, wherein the plurality of outlet openings is configured in a substantially linear arrangement, wherein at least three of the plurality of drains are configured in a saw-toothed arrangement.

Embodiment R is the assembly of embodiment Q, wherein the first flow path comprises a longitudinal axis, wherein the saw-toothed arrangement is aligned substantially parallel to the longitudinal axis.

Embodiment S is the assembly of Embodiment Q, wherein the first flow path comprises a longitudinal axis, wherein the saw-toothed arrangement is aligned substantially orthogonal to the longitudinal axis.

Embodiment T is the assembly of any one of the preceding Embodiments, wherein the second body is adapted to be operationally connected to a vacuum source.

Embodiment U is a kit, comprising the assembly of any one of the preceding Embodiments.

Embodiment V is a kit, comprising:

a first body comprising a plurality of spaced-apart conduits, the conduits configured in a linear array;

wherein the plurality of conduits comprises:

a first conduit having a first opening and a second opening;

a second conduit adjacent the first conduit, the second conduit having a first opening and a second opening; and a second body configured to be operably attached to the first body;

wherein the second body comprises a plurality of spaced-apart chambers; each chamber having conduit-receiving opening, an interior volume, and a drain;

wherein the plurality of spaced-apart chambers comprises:

a first chamber having a first interior volume and a first drain;

a second chamber adjacent the first chamber, the second chamber having a second interior volume and a second drain;

wherein, when the first body and the second body are operably coupled, a portion of the first conduit is disposed in the first interior volume forming a first flow path including the first drain, and a portion of the second conduit is disposed in the second interior volume forming a second flow path including the second drain;

wherein a first shortest distance between the second opening of the first conduit and the second opening of the second conduit is shorter than a second shortest distance between the first drain and the second drain.

Embodiment W is the kit of embodiment V, further comprising a capture element configured to detachably attach to one of the plurality of conduits such that, when detachably attached to the conduit, the first capture element is disposed in fluidic communication with a liquid flow path.

Embodiment X is a kit, comprising:

a first body comprising a plurality of spaced-apart conduits, the conduits configured in a linear array;

wherein the plurality of conduits comprises:

a first conduit having a first opening and a second opening;

a second conduit adjacent the first conduit, the second conduit having a first opening and a second opening;

a second body configured to be operably coupled to the first body;

wherein the second body comprises a plurality of spaced-apart chambers; each chamber having conduit-receiving opening, an interior volume, and a floor comprising a drain;

wherein the plurality of spaced-apart chambers comprises:

a first chamber having a first interior volume and s first floor comprising a first drain;

a second chamber adjacent the first chamber, the second chamber having a second interior volume and a second floor comprising a second drain;

wherein, when the first body and the second body are operably coupled, a portion of the first conduit is disposed in the first interior volume forming a first flow path including the first drain, and a portion of the second conduit is disposed in the second interior volume forming a second flow path including the second drain; and a capture element configured to detachably attach to the first conduit in a manner that places the capture element in fluidic communication with the first flow path, the capture element comprising a capture element depth;

wherein the assembly has a third shortest distance between the second opening of a conduit and the floor of the receiving chamber in which the portion of the conduit is disposed;

wherein in the capture element depth is longer than the third shortest distance.

Embodiment Y is the kit of any one of Embodiments U through X, further comprising a third body, wherein the third body comprises a plurality reservoirs, each reservoir comprising an outlet and the plurality of outlets forming a linear array, wherein the plurality of outlets comprises a first outlet and a second outlet wherein, when operably coupled to the first body of the assembly, the first outlet is placed in fluidic communication with the first conduit and the second outlet is placed in fluidic communication with the second conduit.

Embodiment Z is the kit of any one of Embodiments U through Y, further comprising a lysis reagent or a reagent for detecting a biomolecule.

Embodiment AA is a method of detecting a presence or an absence of an analyte in a liquid sample, comprising:

contacting the liquid sample with a capture element detachably attached to a conduit in any one of the assemblies of Embodiments A through T;

detaching the capture element from the assembly; and detecting a presence or an absence of an analyte retained from the sample by the capture element.

Embodiment BB is the method of Embodiment AA, wherein detaching the capture element from the assembly comprises moving an outlet through the conduit to which the capture element is detachably attached.

Embodiment CC is the method of Embodiment AA or Embodiment BB, further comprising the steps of providing a vacuum source and connecting the assembly to the vacuum source.

The complete disclosure of all patents, patent applications, and publications, and electronically available material cited herein are incorporated by reference. In the event that any inconsistency exists between the disclosure of the present application and the disclosure(s) of any document incorporated herein by reference, the disclosure of the present application shall govern. The foregoing detailed description and examples have been given for clarity of understanding only. No unnecessary limitations are to be understood therefrom. The invention is not limited to the exact details shown and described, for variations obvious to one skilled in the art will be included within the invention defined by the claims.

All headings are for the convenience of the reader and should not be used to limit the meaning of the text that follows the heading, unless so specified.

Various modifications may be made without departing from the spirit and scope of the invention. These and other embodiments are within the scope of the following claims.

The invention claimed is:

1. An assembly for processing a sample, comprising:

a first body comprising a plurality of spaced-apart conduits, the conduits configured in a linear array;

wherein the plurality of conduits comprises:

a first conduit having a first opening and a second opening;

a second conduit adjacent the first conduit, the second conduit having a first opening and a second opening;

a second body operably coupled thereto;

wherein the second body comprises a plurality of spaced-apart chambers; each chamber having conduit-receiving opening, an interior volume, and a drain;

wherein the plurality of spaced-apart chambers comprises:

a first chamber having a first interior volume and a first drain;

a second chamber adjacent the first chamber, the second chamber having a second interior volume and a second drain;

wherein, when the first body and the second body are operably coupled, a portion of the first conduit is disposed in the first interior volume forming a first flow path including the first drain, and a portion of the second conduit is disposed in the second interior volume forming a second flow path including the second drain; and a capture element detachably attached to the first conduit and disposed in fluidic communication with the first flow path;

wherein a first shortest distance between the second opening of the first conduit and the second opening of the second conduit is shorter than a second shortest distance between the first drain and the second drain; and further comprising a third body operably coupled to the first body of the assembly, wherein the third body comprises a plurality reservoirs, each reservoir comprising an outlet and the plurality of outlets forming a linear array, wherein the plurality of outlets comprises a first outlet and a second outlet wherein, when operably coupled to the first body of the assembly, the first outlet is placed in fluidic communication with the first conduit and the second outlet is placed in fluidic communication with the second conduit; and wherein each of the outlets separately extends from the third body and is inserted at least partially into the corresponding conduit in the first body.

2. The assembly of claim 1, wherein each of the plurality of chambers comprises a floor, wherein the floor of each of the plurality of chambers comprises the drain.

3. The assembly of claim 1;

wherein the capture element comprises a capture element depth;

wherein the assembly has a third shortest distance between the second opening of a conduit and the floor of the receiving chamber in which the portion of the conduit is disposed;

wherein in the capture element depth is longer than the third shortest distance.

4. An assembly for processing a sample, comprising:

a first body comprising a plurality of spaced-apart conduits, the conduits configured in a linear array;

wherein the plurality of conduits comprises:

a first conduit having a first opening and a second opening;

a second conduit adjacent the first conduit, the second conduit having a first opening and a second opening;

a second body operably coupled thereto;

wherein the second body comprises a plurality of spaced-apart chambers; each chamber having conduit-receiving opening, an interior volume, and a floor comprising a drain;

wherein the plurality of spaced-apart chambers comprises:

a first chamber having a first interior volume and s first floor comprising a first drain;

a second chamber adjacent the first chamber, the second chamber having a second interior volume and a second floor comprising a second drain;

wherein, when the first body and the second body are operably coupled, a portion of the first conduit is disposed in the first interior volume forming a first flow path including the first drain, and a portion of the second conduit is disposed in the second interior volume forming a second flow path including the second drain; and a capture element detachably attached to the first conduit and disposed in fluidic communication with the first flow path, the capture element comprising a capture element depth;

wherein the assembly has a third shortest distance between the second opening of a conduit and the floor of the receiving chamber in which the portion of the conduit is disposed;

wherein in the capture element depth is longer than the third shortest distance; and further comprising a third body operably coupled to the first body of the assembly, wherein the third body comprises a plurality reservoirs, each reservoir comprising an outlet and the plurality of outlets forming a linear array, wherein the plurality of outlets comprises a first outlet and a second outlet wherein, when operably coupled to the first body of the assembly, the first outlet is placed in fluidic communication with the first conduit and the second outlet is placed in fluidic communication with the second conduit; and wherein each of the outlets separately extends from the third body and is inserted at least partially into the corresponding conduit in the first body.

5. The assembly of claim 4, wherein a first shortest distance between the second opening of the first conduit and the second opening of the second conduit is shorter than a second shortest distance between the first drain and the second drain.

6. The assembly of claim 2, wherein the floor further comprises a trough extending along a portion of the floor to the drain.

7. The assembly of claim 1, wherein at least a portion of the capture element is disposed in the first conduit.

8. The assembly of claim 1, further comprising a third body operably coupled to the first body of the assembly, wherein the third body comprises a plurality reservoirs, each reservoir comprising an outlet and the plurality of outlets forming a linear array, wherein the plurality of outlets comprises a first outlet and a second outlet wherein, when operably coupled to the first body of the assembly, the first outlet is placed in fluidic communication with the first conduit and the second outlet is placed in fluidic communication with the second conduit.

9. The assembly of claim 8, wherein the first body or third body comprises a first positioning element configured to orient the third body in a predefined location with respect to the first body.

10. The assembly of claim 9, wherein the first or third body further comprises a second positioning element configured to act cooperatively with the first positioning element to orient the third body in a predefined location with respect to the first body.

11. The assembly of claim 1, wherein the first body is adapted to sealingly couple to the second body and/or the second body is adapted to sealingly couple to the first body.

12. The assembly of claim 1, wherein the two or more outlets of the first body are shaped, dimensioned, and spaced apart such that each outlet individually can be received by a container.

13. The assembly of claim 1, wherein the plurality of outlet openings is configured in a substantially linear arrangement, wherein at least three of the plurality of drains is configured in a saw-toothed arrangement.

14. The assembly of claim 1, wherein the second body is adapted to be operationally connected to a vacuum source.

15. A kit, comprising:

a first body comprising a plurality of spaced-apart conduits, the conduits configured in a linear array;

wherein the plurality of conduits comprises:

a first conduit having a first opening and a second opening;

a second conduit adjacent the first conduit, the second conduit having a first opening and a second opening; and a second body configured to be operably attached to the first body;

wherein the second body comprises a plurality of spaced-apart chambers; each chamber having conduit-receiving opening, an interior volume, and a drain;

wherein the plurality of spaced-apart chambers comprises:

a first chamber having a first interior volume and a first drain;

a second chamber adjacent the first chamber, the second chamber having a second interior volume and a second drain;

wherein, when the first body and the second body are operably coupled, a portion of the first conduit is disposed in the first interior volume forming a first flow path including the first drain, and a portion of the second conduit is disposed in the second interior volume forming a second flow path including the second drain;

wherein a first shortest distance between the second opening of the first conduit and the second opening of the second conduit is shorter than a second shortest distance between the first drain and the second drain; and a capture element configured to detachably attach to one of the plurality of conduits such that, when detachably attached to the conduit, the first capture element is disposed in fluidic communication with a liquid flow path; and further comprising a third body operably coupled to the first body of the assembly, wherein the third body comprises a plurality reservoirs, each reservoir comprising an outlet and the plurality of outlets forming a linear array, wherein the plurality of outlets comprises a first outlet and a second outlet wherein, when operably coupled to the first body of the assembly, the first outlet is placed in fluidic communication with the first conduit and the second outlet is placed in fluidic communication with the second conduit; and wherein each of the outlets separately extends from the third body and is inserted at least partially into the corresponding conduit in the first body.

16. The kit of claim 15, further comprising a capture element configured to detachably attach to one of the plurality of conduits such that, when detachably attached to the conduit, the first capture element is disposed in fluidic communication with a liquid flow path.

17. A kit, comprising:

a first body comprising a plurality of spaced-apart conduits, the conduits configured in a linear array;

wherein the plurality of conduits comprises:

a first conduit having a first opening and a second opening;

a second conduit adjacent the first conduit, the second conduit having a first opening and a second opening;

a second body operably coupled thereto;

wherein the second body comprises a plurality of spaced-apart chambers; each chamber having conduit-receiving opening, an interior volume, and a floor comprising a drain;

wherein the plurality of spaced-apart chambers comprises:

a first chamber having a first interior volume and s first floor comprising a first drain;

a second chamber adjacent the first chamber, the second chamber having a second interior volume and a second floor comprising a second drain;

wherein, when the first body and the second body are operably coupled, a portion of the first conduit is disposed in the first interior volume forming a first flow path including the first drain, and a portion of the second conduit is disposed in the second interior volume forming a second flow path including the second drain; and a capture element configured to detachably attach to the first conduit in a manner that places the capture element in fluidic communication with the first flow path, the capture element comprising a capture element depth;

wherein the assembly has a third shortest distance between the second opening of a conduit and the floor of the receiving chamber in which the portion of the conduit is disposed;

wherein in the capture element depth is longer than the third shortest distance; and and further comprising a third body operably coupled to the first body of the assembly, wherein the third body comprises a plurality reservoirs, each reservoir comprising an outlet and the plurality of outlets forming a linear array, wherein the plurality of outlets comprises a first outlet and a second outlet wherein, when operably coupled to the first body of the assembly, the first outlet is placed in fluidic communication with the first conduit and the second outlet is placed in fluidic communication with the second conduit; and wherein each of the outlets separately extends from the third body and is inserted at least partially into the corresponding conduit in the first body.

18. The kit of claim 15, further comprising a third body, wherein the third body comprises a plurality reservoirs, each reservoir comprising an outlet and the plurality of outlets forming a linear array, wherein the plurality of outlets comprises a first outlet and a second outlet wherein, when operably coupled to the first body of the assembly, the first outlet is placed in fluidic communication with the first conduit and the second outlet is placed in fluidic communication with the second conduit.

* * * * *